US009110394B2

(12) United States Patent
Kim et al.

(10) Patent No.: US 9,110,394 B2
(45) Date of Patent: Aug. 18, 2015

(54) IMAGE FORMING APPARATUS AND CONTROL METHOD FOR THE SAME

(71) Applicant: Samsung Electronics Co., Ltd., Suwon-si (KR)

(72) Inventors: Soo Yong Kim, Suwon-si (KR); Sang Bum Woo, Seoul (KR); Sung Dae Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/161,993

(22) Filed: Jan. 23, 2014

(65) Prior Publication Data

US 2014/0301758 A1 Oct. 9, 2014

(30) Foreign Application Priority Data

Apr. 3, 2013 (KR) ..... 10-2013-0036190

(51) Int. Cl.
*G03G 15/01* (2006.01)
*G03G 15/00* (2006.01)

(52) U.S. Cl.
CPC ..... *G03G 15/0121* (2013.01); *G03G 15/0189* (2013.01); *G03G 15/5058* (2013.01); *G03G 2215/0161* (2013.01)

(58) Field of Classification Search
USPC ..... 399/297–302, 308
See application file for complete search history.

(56) References Cited

U.S. PATENT DOCUMENTS 8,867,973 B2 * 10/2014 Masui ..... 399/301

* cited by examiner

*Primary Examiner* — Hoan Tran
(74) *Attorney, Agent, or Firm* — Staas & Halsey LLP

(57) ABSTRACT

An image forming apparatus, which achieves reduced color registration time and real-time calibration of color position shift, and a control method for the same, is provided. The image forming apparatus includes plural photoconductors corresponding to plural colors, an exposure unit to form an electrostatic latent image by emitting light to the photoconductors, a developing unit to form a toner image by feeding toner to the photoconductors, an intermediate transfer body to which the toner image, formed on each photoconductor, is transferred, a sensing unit to sense the toner image formed on the intermediate transfer body, and a controller which forms images in respective image forming sections of the intermediate transfer body and test-pattern sets for color registration in respective blanks between the neighboring image forming sections, the controller implementing color registration calibration using color registration calibration values acquired from four test pattern sets among the formed test pattern sets.

15 Claims, 26 Drawing Sheets

IMAGE FORMING APPARATUS AND CONTROL METHOD FOR THE SAME

CROSS-REFERENCE TO RELATED APPLICATIONS

This application claims the priority benefit of Korean Patent Application No. 10-2013-0036190, filed on Apr. 3, 2013 in the Korean Intellectual Property Office, the disclosure of which is incorporated herein by reference.

BACKGROUND

1. Field

Embodiments relate to an image forming apparatus to form a color image in a single-pass manner, and a control method for the same.

2. Description of the Related Art

In general, an electro-photographic image forming apparatus, such as a laser printer, digital copier, or the like, is an apparatus in which light is emitted to a photosensitive medium charged with a predetermined potential such that an electrostatic latent image is formed on a surface of the photosensitive medium and toner as a developing agent is fed to the electrostatic latent image to develop the electrostatic latent image into a visible image to be transferred to paper to complete image printing.

In the case of a color image forming apparatus, deterioration in the quality of an image, such as image edge blurring, may occur if different color images overlap one another at incorrect positions. Since this occurs due to complex interaction between several factors, such as replacement of a developing device, increase in the number of printed sheets, etc., color registration to align different color images so as to overlap one another at correct positions may be necessary.

Conventionally, to judge position shift per color or to implement color registration based on position shift, it may be necessary to implement additional work during printing, which causes deterioration in the efficiency of printing. In addition, high-reliability color registration may be difficult because real-time application of position shift is impossible.

SUMMARY

In an aspect of one or more embodiments, there is provided an image forming apparatus which may reduce time required for color registration and which may calibrate color position shift of all printed matters in real time by applying position shift between colors in real time, and a control method for the same.

In accordance with an aspect of one or more embodiments, an image forming apparatus includes a plurality of photoconductors corresponding to a plurality of colors, an exposure unit configured to form an electrostatic latent image by emitting light to the plurality of photoconductors, a developing unit configured to form a toner image by feeding toner to the plurality of photoconductors, an intermediate transfer body to which the toner image, formed on each of the plurality of photoconductors, is transferred, a sensing unit configured to sense the toner image formed on the intermediate transfer body, and a controller which forms images in a plurality of image forming sections of the intermediate transfer body and forms test-pattern sets for color registration in respective blanks between the neighboring image forming sections, and which implements color registration calibration using color registration calibration values acquired from four test pattern sets among the formed test pattern sets.

The controller may form the test pattern sets for color registration in the blanks between the respective neighboring image forming sections in a one to one ratio.

The controller may implement color registration calibration using an average calibration value of the color registration calibration values acquired from the four test pattern sets.

The controller may acquire an average calibration value from an $m^{th}$ test pattern set to an $m+3^{rd}$ test pattern set when m is an integer of 1 or more, and implements the color registration calibration on an image of an $m+3^{rd}$ image forming section and an $m+4^{th}$ test pattern set.

The single test pattern set may include at least one reference color pattern and at least one comparative color pattern.

The single test pattern set may include a plurality of reference color patterns and a plurality of comparative color patterns.

The plurality of photoconductors may be arranged side by side in tandem in a movement direction of the intermediate transfer body.

In accordance with an aspect of one or more embodiments, an image forming apparatus includes a plurality of photoconductors corresponding to a plurality of colors, an exposure unit configured to form an electrostatic latent image by emitting light to the plurality of photoconductors, a developing unit configured to form a toner image by feeding toner to the plurality of photoconductors, an intermediate transfer body to which the toner image, formed on each of the plurality of photoconductors, is transferred, a sensing unit configured to sense the toner image formed on the intermediate transfer body, and a controller which forms images in a plurality of image forming sections of the intermediate transfer body and forms test-pattern sets for color registration in respective blanks between the neighboring image forming sections and which implements color registration calibration using color registration calibration values acquired from four or less test pattern sets among the formed test pattern sets, wherein the color registration calibration value acquired from the first test pattern set is used to implement the color registration calibration on the image of the first image forming section and the second test pattern set, wherein the color registration calibration values acquired from the first test pattern set and the second test pattern set are used to implement the color registration calibration on the image of the second image forming section and the third test pattern set, wherein the color registration calibration values acquired from the first test pattern set to the third test pattern set are used to implement the color registration calibration on the image of the third image forming section and the third test pattern set, and wherein, assuming that m is an integer of 1 or more, calibration values are acquired from an $m^{th}$ test pattern set to an $m+3^{rd}$ test pattern set and used to implement the color registration calibration on an image of an $m+3^{rd}$ image forming section and an $m+4^{th}$ test pattern set.

The controller may implement color registration calibration using an average calibration value of the color registration calibration values acquired from the four test pattern sets.

The single test pattern set may include at least one reference color pattern and at least one comparative color pattern.

The single test pattern set may include a plurality of reference color patterns and a plurality of comparative color patterns.

The plurality of photoconductors may be arranged side by side in tandem in a movement direction of the intermediate transfer body.

In an aspect of one or more embodiments, there is provided a control method for an image forming apparatus including a plurality of photoconductors corresponding to a plurality of colors, an exposure unit configured to form an electrostatic latent image by emitting light to the plurality of photoconductors, a developing unit configured to form a toner image by feeding toner to the plurality of photoconductors, an intermediate transfer body to which the toner image, formed on each of the plurality of photoconductors, is transferred, and a sensing unit configured to sense the toner image formed on the intermediate transfer body, the method includes forming images in a plurality of image forming sections of the intermediate transfer body and test-pattern sets for color registration in respective blanks between the neighboring image forming sections, and implementing color registration calibration using color registration calibration values acquired from four or less test pattern sets among the formed test pattern sets.

The color registration calibration value acquired from the first test pattern set may be used to implement the color registration calibration on the image of the first image forming section and the second test pattern set, the color registration calibration values acquired from the first test pattern set and the second test pattern set may be used to implement the color registration calibration on the image of the second image forming section and the third test pattern set, and the color registration calibration values acquired from the first test pattern set to the third test pattern set may be used to implement the color registration calibration on the image of the third image forming section and the third test pattern set.

The color registration calibration may be implemented using an average calibration value of the color registration calibration values acquired from the four test pattern sets.

Assuming that m is an integer of 1 or more, a first average calibration value may be acquired from an $m^{th}$ test pattern set to an $m+3^{rd}$ test pattern set and used to implement the color registration calibration on an image of an $m+3^{rd}$ image forming section and an $m+4^{th}$ test pattern set.

The single test pattern set may include at least one reference color pattern and at least one comparative color pattern.

The single test pattern set may include a plurality of reference color patterns and a plurality of comparative color patterns.

The plurality of photoconductors may be arranged side by side in tandem in a movement direction of the intermediate transfer body.

In accordance with an aspect of one or more embodiments, there is provided an image forming apparatus including a sensing unit configured to sense a toner image formed on an intermediate transfer body from a plurality of toner colors; and a controller which forms images in a plurality of image forming sections of the intermediate transfer body and forms four test-pattern sets for color registration in respective blanks between neighboring image forming sections, and which implements color registration calibration using color registration calibration values acquired from four or less test pattern sets among the formed test pattern sets.

In accordance with an aspect of one or more embodiments, there is provided a control method for an image forming apparatus including a sensing unit configured to sense a toner image formed on an intermediate transfer body, the method including forming images in a plurality of image forming sections of the intermediate transfer body and test-pattern sets for color registration in respective blanks between the neighboring image forming sections; and implementing color registration calibration using color registration calibration values acquired from four or less test pattern sets among the formed test pattern sets.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Embodiments with regard to an image forming apparatus and a control method for the same will be described in detail with reference to the accompanying drawings.

Figure 1:
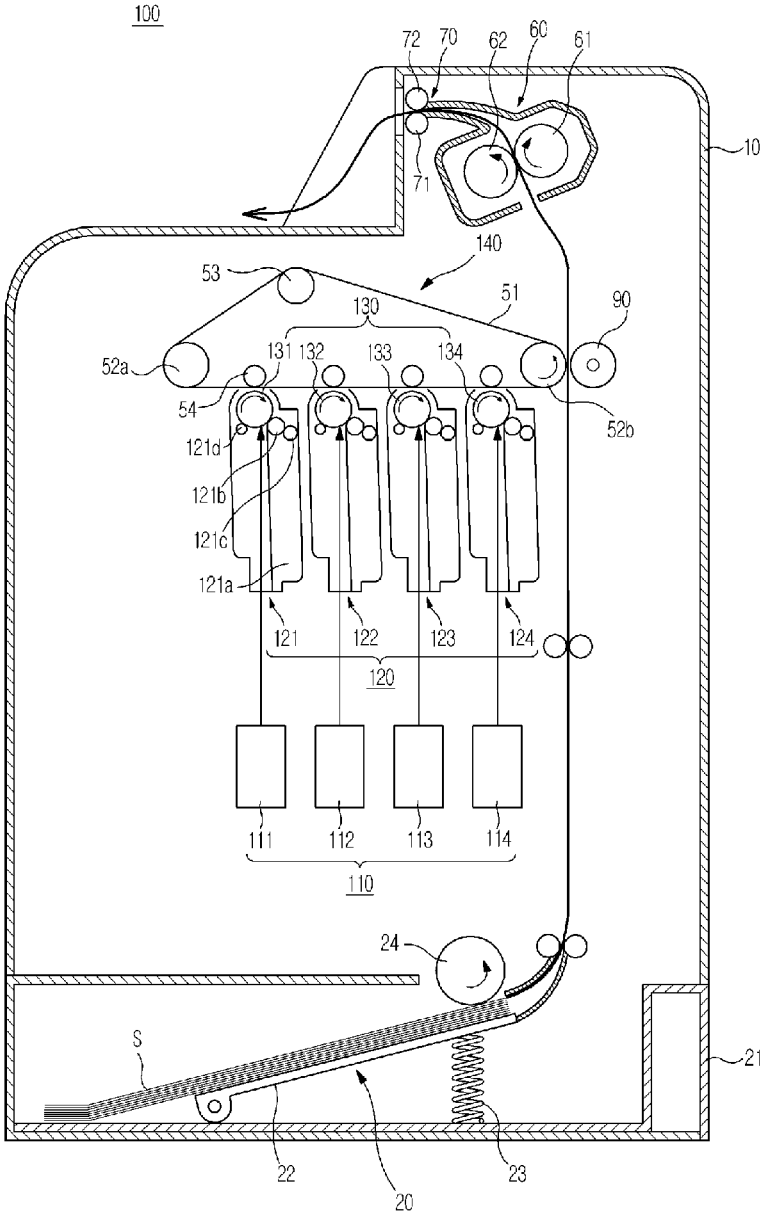
FIG. 1 is a side sectional view showing a schematic configuration of an image forming apparatus according to an embodiment.

FIG. 1 is a side sectional view showing a schematic configuration of the image forming apparatus according to an embodiment. In FIG. 1, illustration of sensing units is omitted and arrangement of sensing units will be described later with reference to FIG. 4.

An embodiment is applied to an image forming apparatus that forms a color image in a single-pass manner.

Referring to FIG. 1, the single-pass type color image forming apparatus according to an embodiment, designated by reference numeral 100, includes a main body 10 defining an external appearance of the apparatus, and a paper feeder unit 20, an exposure unit 110, a developing unit 120, a photosensitive unit 130, an intermediate transfer body 140, a transfer roller 90, a fixing unit 60, and a paper discharge unit 70, which are accommodated in the main body 10. In the drawing, arrows sequentially arranged from the paper feeding unit 20 to the paper discharge unit 70 designate a delivery path of paper S.

The paper feeder unit 20 includes a paper cassette 21 separably coupled to the bottom of the main body 10, a paper push plate 22 vertically pivotally mounted in the paper cassette 21 such that paper S is stacked on the paper push plate 22, an elastic member 23 provided below the paper push plate 22 to elastically support the paper push plate 22, and a pickup roller 24 provided at a tip end of the paper S stacked on the paper push plate 22 to pick up the paper S. The paper S picked up by the pickup roller 24 is delivered along a paper delivery path. As needed, rollers or support members may be additionally provided on the paper delivery path to assist delivery of the paper S.

The exposure unit 110 serves to emit light corresponding to information regarding a plurality of different color images, for example, black (K), yellow (Y), magenta (M), cyan (C) images. A Laser Scanning Unit (LSU) using a laser diode as a light source may be used.

The exposure unit 110 may include a plurality of exposure devices corresponding to respective colors. In one embodiment, the exposure unit 110 may include a first exposure device 111, a second exposure device 112, a third exposure device 113, and a fourth exposure device 114, which correspond to four colors. Each exposure device is adapted to emit light to a corresponding photoconductor so as to form an electrostatic latent image. Likewise, the photosensitive unit 130 may include a first photoconductor 131, a second photoconductor 132, a third photoconductor 133, and a fourth photoconductor 134, which correspond to four colors. The photoconductor may be a photosensitive drum in which a photo conductive layer is provided at an outer circumferential surface of a cylindrical metal drum, and the first photoconductor 131 to the fourth photoconductor 134 are sequentially arranged in a movement direction of the intermediate transfer body 140.

The developing unit 120 includes a first developing device 121, a second developing device 122, a third developing device 123, and a fourth developing device 124, in which different colors of toners, for example, black (K), yellow (Y), magenta (M), and cyan (C) toners are stored.

The first developing device 121 includes a first toner reservoir 121*a* in which toner is stored, a first charging roller 121*d* to charge the first photoconductor 131, a first developing roller 121*b* to develop the electrostatic latent image formed on the first photoconductor 131 into a toner image, and a first feeding roller 121*c* to feed first toner to the first developing roller 121*b*. Likewise, the other developing devices 122, 123 and 124 respectively include a toner reservoir, a charging roller, a developer roller, and a feeding roller.

Although other various colors of toners except for yellow, magenta, cyan and black toners may be used in an embodiment, for convenience of description, an embodiment will be described hereinafter as using the aforementioned four colors of toners.

The intermediate transfer body 140 serves as an intermediate medium to transfer the toner images developed on the outer circumferential surface of the respective photoconductors 131, 132, 133 and 134 to the paper S. The intermediate transfer body 140 may take the form of an intermediate transfer belt 51 that circulates in contact with the respective photoconductors 131, 132, 133 and 134. The intermediate transfer belt 51 may be driven by drive rollers 52*a* and 52*b*, and a support roller 53 may maintain tension of the intermediate transfer body 140. In addition, the image forming apparatus 100 may include four intermediate transfer rollers 54*a*, 54*b*, 54*c* and 54*d* to transfer the toner images formed on the outer circumferential surface of the respective photoconductors 131, 132, 133 and 134 to the intermediate transfer body 140.

The transfer roller 90 is located opposite to the drive roller 52*b* of the intermediate transfer body 140. As the paper S passes a gap between the drive roller 52*b* and the transfer roller 90 during rotation of the drive roller 52*b* and the transfer roller 90, the toner images formed on the intermediate transfer body 140 are transferred to the paper S.

The fusing unit 60 fixes the toner images to the paper S by applying heat and pressure to the paper S. The fusing unit 60 includes a heating roller 61 having a heat source to apply heat to the paper S to which the toner images has been transferred, and a pressure roller 62 located opposite to the heating roller 61 to maintain a constant fixing pressure between the pressure roller 62 and the heating roller 61.

The paper discharge unit 70 serves to discharge the printed paper S from the main body 10. The paper discharge unit 70 includes a discharge roller 71 and a backup roller 72 that is rotated along with the discharge roller 71.

Detailed operations of the image forming apparatus according to an embodiment will be described hereinafter based on the above-described basic operations of the image forming apparatus.

Figure 2:
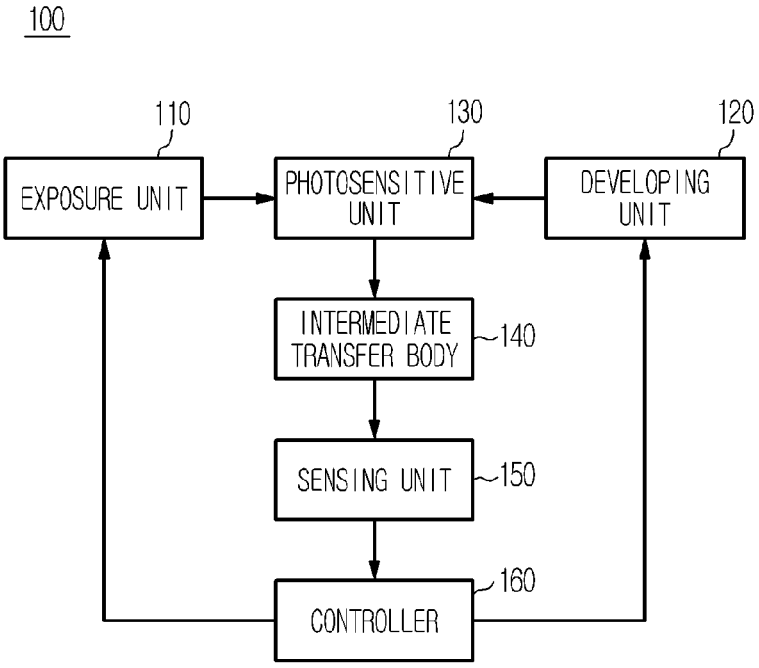
FIG. 2 is a control block diagram of the image forming apparatus according to an embodiment.

FIG. 2 is a control block diagram of the image forming apparatus according to an embodiment.

Referring to FIG. 2, the image forming apparatus 100 includes the exposure unit 110 that emits light to a plurality of photoconductors provided on a per color basis to form electrostatic latent images on the respective photoconductors, the developing unit 120 that feeds different colors of toners corresponding to the plurality of photoconductors on which the electrostatic latent images have been formed to form toner images, the photosensitive unit 130 including the plurality of photoconductors, the intermediate transfer body 140 to which the toner images formed on the plurality of photoconductors are transferred, a sensing unit 150 that senses the toner images transferred to the intermediate transfer body 140, and a controller 160 that controls exposure timing of the exposure unit 110 based on output values of the sensing unit 150.

In an embodiment, the sensing unit 150 includes a first sensing unit that is located between a first photoconductor and a second photoconductor in a movement direction of the intermediate transfer body 140 to sense the toner image transferred to the intermediate transfer body 140, and a second sensing unit that is located downstream of a final photoconductor in a movement direction of the intermediate transfer body 140 to sense the toner image transferred to the intermediate transfer body 140.

The controller 160 calculates fixed error of each color with respect to a first color among the plurality of colors based on output values of the first sensing unit and the second sensing unit before printing, and calculates variation error based on an output value of the first sensing unit during printing, thereby controlling exposure timing for the respective colors except for the first color using the fixed error and the variation error.

Figure 3:
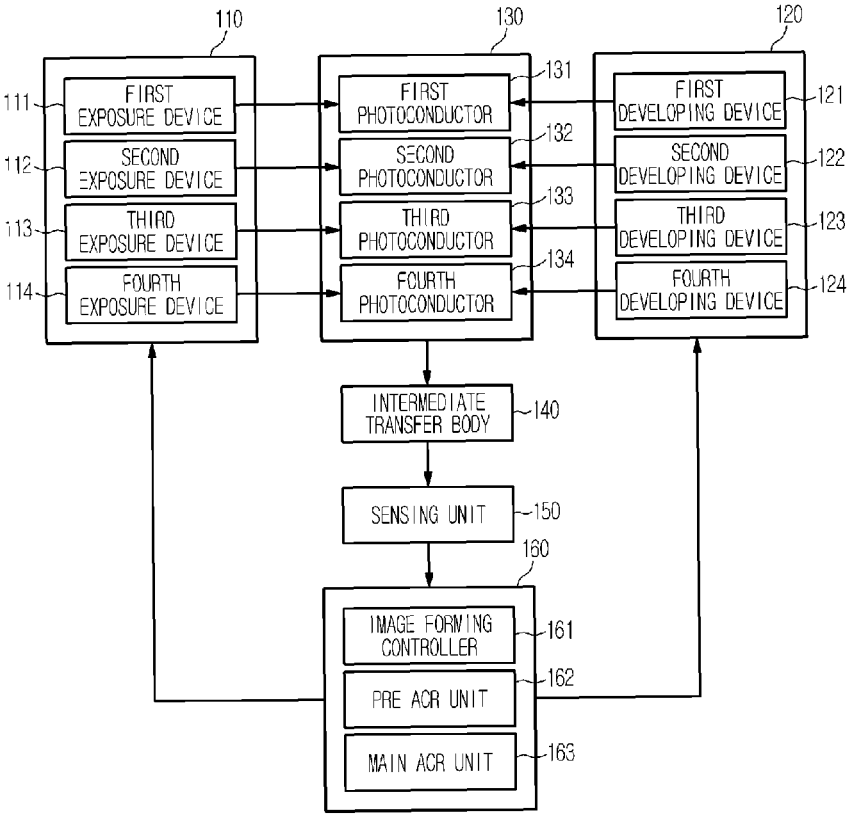
FIG. 3 is a control block diagram showing the configuration of the image forming apparatus according to an embodiment.

FIG. 3 is a control block diagram showing the configuration of the image forming apparatus according to an embodiment.

As described above, the image forming apparatus 100 according to an embodiment may form an image using four colors. The exposure unit 110 includes the first exposure device 111, the second exposure device 112, the third exposure device 113, and the fourth exposure device 114, which correspond to the four colors. The developing unit 120 includes the first developing device 121, the second developing device 122, the third developing device 123, and the fourth developing device 124, and the photosensitive unit 130 includes the first photoconductor 131, the second photoconductor 132, the third photoconductor 133, and the fourth photoconductor 134.

More specifically, the first exposure device 111 forms an electrostatic latent image corresponding to first color image information on the first photoconductor 131, and the first developing device 121 feeds first color of toner to the electrostatic latent image. The second exposure device 112 forms an electrostatic latent image corresponding to second color image information on the second photoconductor 132, and the second developing device 122 feeds second color of toner to the electrostatic latent image. The third exposure device 113 forms an electrostatic latent image corresponding to third color image information on the third photoconductor 133, and the third developing device 123 feeds third color of toner to the electrostatic latent image. The fourth exposure device 114 forms an electrostatic latent image corresponding to fourth color image information on the fourth photoconductor 134, and the fourth developing device 124 feeds fourth color of toner to the electrostatic latent image.

The controller 160 includes an image forming controller 161 that controls the exposure unit 110 and the developing unit 120 to transfer a test pattern to the intermediate transfer body 140, a pre Auto Color Registration (ACR) unit 162 that calculates fixed error before printing, and a main ACR unit 163 that calculates variation error during printing and controls exposure timing using the fixed error and the variation error.

The test pattern transferred to the intermediate transfer body 140 is sensed by the sensing unit 150, and the pre ACR unit 162 and the main ACR unit 163 calculate fixed error and variation error based on an output value of the sensing unit 150. To this end, the sensing unit 150 is mounted at a position where it may sense a test pattern on a per color basis. An arrangement of the sensing unit 150 will be described with reference to FIG. 4.

Figure 4:
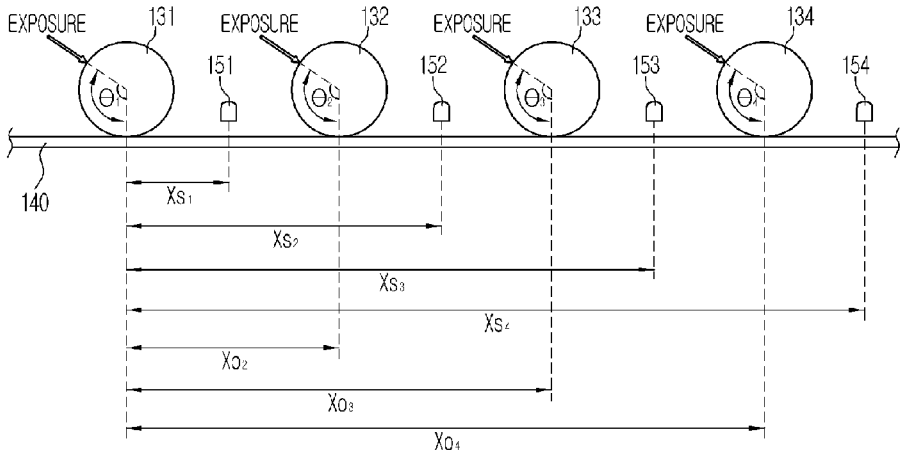
FIG. 4 is a view showing arrangement of sensing units included in the image forming apparatus according to an embodiment.

FIG. 4 is a view showing arrangement of sensing units included in the image forming apparatus according to an embodiment. Referring to FIG. 4, the sensing unit 150 includes a first sensing unit 151 located between the first photoconductor 131 and the second photoconductor 132, a second sensing unit 152 located between the second photoconductor 132 and the third photoconductor 133, a third sensing unit 153 located between the third photoconductor 133 and the fourth photoconductor 134, and a fourth sensing unit 154 located downstream of a final photoconductor, i.e. the fourth photoconductor 134.

The first sensing unit 151 to the fourth sensing unit 154 may respectively include a sensor for pattern recognition. The sensor may be an optical sensor that includes a light emitting element to emit light to the intermediate transfer body 140 and a light receiving element to receive light reflected from the intermediate transfer body 140. Each sensor may be provided at either end of the intermediate transfer body 140 as exemplarily shown in FIG. 5A because both ends of the intermediate transfer body 140 in a width direction thereof may exhibit different color registrations due to skew scan of the exposure unit 110. Note that this is but one embodiment, and the kind of sensor is not limited so long as the sensor may recognize a pattern transferred to the intermediate transfer body 140. In addition, the first sensing unit 151 to the fourth sensing unit 154 may be provided respectively with a single sensor.

Each of the first sensing unit 151 to the fourth sensing unit 154 may be provided with a counter. The counter serves to measure time taken until each color pattern is sensed by the sensor after exposure of the pattern on a corresponding photoconductor. As such, the sensing unit 150 may measure position error between colors based on time. Note that the counter is not to be essentially mounted along with the sensor and is not limited to a position of FIG. 4 or a position of FIG. 8.

The image forming apparatus 100 according to an embodiment calculates fixed error of each color via pre ACR before printing and calculates variation error via main ACR during printing, thereby controlling exposure timing using both the fixed error and the variation error. First, pre ACR will be described.

Pre ACR is implemented before printing begins. The pre ACR enables measurement of color position error caused by initial light-emission position-error of each exposure device, rotational-center position-error of each photoconductor, and installation position-error of each sensor. The errors measured by pre ACR are basic errors caused upon installation and are not variable during printing. Thus, the errors measured by pre ACR are referred to as fixed errors. The pre ACR may be implemented once after manufacture of the image forming apparatus 100 is completed, or may be implemented after components of the image forming apparatus 100, such as the exposure unit 110, the photosensitive unit 130, the intermediate transfer body 140, or the like is replaced, or may be implemented when a pre ACR implementation instruction is input by a user. The user may input the pre ACR implementation instruction when occurrence of mechanical errors is expected, such as the case in which substantial shock is applied from the outside.

Pre-test patterns for pre ACR according to an embodiment will be described with reference to FIGS. 5A to 5D. FIGS. 5A to 5D are views showing pre-test patterns transferred to the intermediate transfer body via pre ACR. To implement pre ACR, first, the image forming controller 161 controls the exposure unit 110 and the developing unit 120 to form a pre-test pattern on each photoconductor, and the pre-test pattern formed on each photoconductor is transferred to the intermediate transfer body 140. The pre-test pattern is used to measure position shift on a per color basis, and the kind of pattern is not limited so long as the sensing unit 150 may recognize the pattern.

Figure 5A:
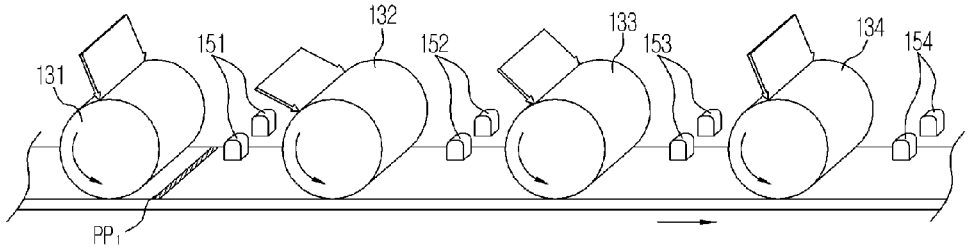
FIGS. 5A to 5D are views showing pre-test patterns transferred to an intermediate transfer body via pre ACR.

First, as exemplarily shown in FIG. 5A, if a first-color pre-test pattern PP1 is transferred from the first photoconductor 131 to the intermediate transfer body 140, the first sensing unit 151 senses the same, and measures time taken until the first-color pre-test pattern PP1 is sensed by the first sensing unit 151 after exposure thereof.

Figure 5B:
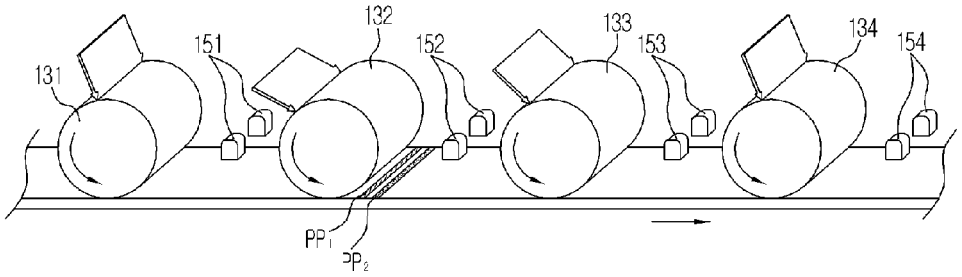

As exemplarily shown in FIG. 5B, if a second-color pre-test pattern PP2 is transferred from the second photoconductor 132 to the intermediate transfer body 140, the second sensing unit 152 senses the second-color pre-test pattern PP2 as well as the first-color pre-test pattern PP1 and measures time taken until each pattern is sensed by the second sensing unit 152 after exposure thereof.

Figure 5C:
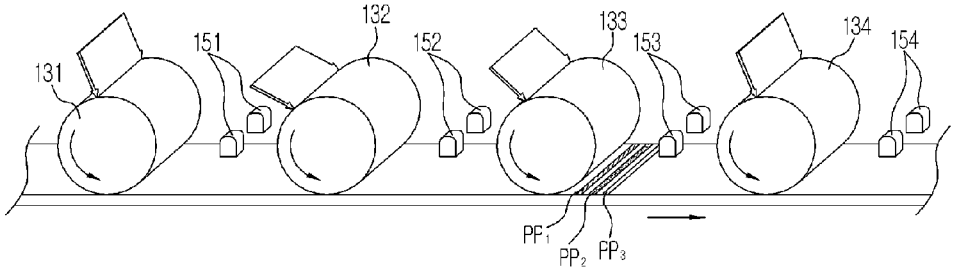

As exemplarily shown in FIG. 5C, if a third-color pre-test pattern PP3 is transferred from the third photoconductor 133 to the intermediate transfer body 140, the third sensing unit 153 senses the first-color pre-test pattern PP1 to the third-color pre-test pattern PP3 and measures time taken until the each pattern is sensed by the third sensing unit 153 after exposure thereof.

Figure 5D:
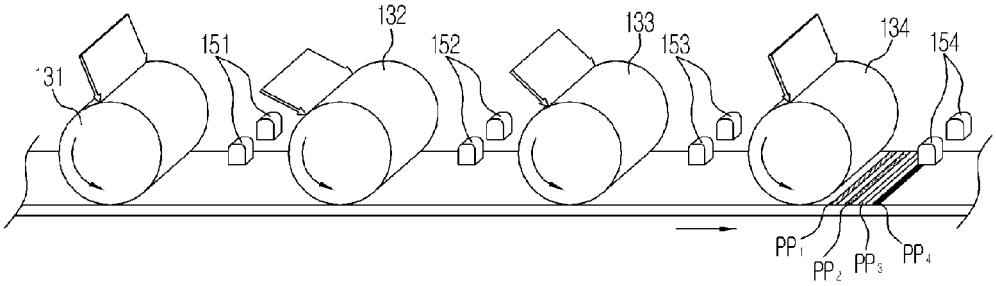

Then, as exemplarily shown in FIG. 5D, if a fourth-color pre-test pattern PP4 is transferred from the fourth photoconductor 134 to the intermediate transfer body 140, the fourth sensing unit 154 senses the first-color pre-test pattern PP1 to the fourth-color pre-test pattern PP4 and measures time taken until each pattern is sensed by the fourth sensing unit 154 after exposure thereof.

Referring again to FIG. 4, a distance from the rotational center of the first photoconductor 131 to the rotational center of the second photoconductor 132 is designated by Xo2, a distance from the rotational center of the first photoconductor 131 to the rotational center of the third photoconductor 133 is designated by Xo3, and a distance from the rotational center of the first photoconductor 131 to the rotational center of the fourth photoconductor 134 is designated by Xo4.

A distance from the rotational center of the first photoconductor 131 to the first sensing unit 151 is designated by Xs1, a distance from the rotational center of the first photoconductor 131 to the second sensing unit 152 is designated by Xs2, a distance from the rotational center of the first photoconductor 131 to the third sensing unit 153 is designated by Xs3, and a distance from the rotational center of the first photoconductor 131 to the fourth sensing unit 154 is designated by Xs4.

In addition, angles between exposure positions of the respective photoconductors 131, 132, 133 and 134 and transfer positions on the intermediate transfer body 140 are designated by θ1, θ2, θ3, and θ4, rotational angular velocity of the respective photoconductors 131, 132, 133 and 134 are designated by W1, W2, W3, and W4, and a movement velocity of the intermediate transfer body 140 is designated by Vb.

All of the above values are design values. Design time Tij taken from when exposure of an $i^{th}$ photosensitive drum begins to when a $j^{th}$ sensing unit senses that an image developed on the $i^{th}$ photosensitive drum is transferred to the intermediate transfer body 140 may be represented by the following Equation 1.

$$Tij=(Xsj-Xoi)/Vb+\theta i/Wi \qquad \text{Equation 1}$$

If i is 1, Xoi is 0. Since a real measured time PTij contains exposure position-error $\delta\theta_i$, rotational-center position-error of the photoconductor $\delta X_{oi}$, and position-error of the sensing unit $\delta X_{sj}$, a difference between the design time Tij and the real measured time PTij may be represented by the following Equation 2.

$$Y1=PT11-T11=\delta Xs1/Vb+\delta\theta 1/W1$$

$$Y2=PT12-T12=\delta Xs2/Vb+\delta\theta 1/W1$$

$$Y3=PT13-T13=\delta Xs3/Vb+\delta\theta 1/W1$$

$$Y4=PT14-T14=\delta Xs4/Vb+\delta\theta 1/W1$$

$$Y5=PT24-T24=(\delta Xs4-\delta Xo2)/Vb+\delta\theta 2/W2$$

$$Y6=PT34-T34=(\delta Xs4-\delta Xo3)/Vb+\delta\theta 3/W3$$

$$Y7=PT44-T44=(\delta Xs4-\delta Xo4)/Vb+\delta\theta 4/W4$$

$$Y8=PT22-T22=(\delta Xs2-\delta Xo2)/Vb+\delta\theta 2/W2$$

$$Y9=PT33-T33=(\delta Xs3-\delta Xo3)/Vb+\delta\theta 3/W3$$

$$Y10=PT23-T23=(\delta Xs3-\delta Xo2)/Vb+\delta\theta 2/W2 \qquad \text{Equation 2}$$

The error, represented as time difference by Equation 2, may refer to position error on a per color basis. If the linear velocity of the intermediate transfer body 140 and the surface velocity of the photoconductors 131, 132, 133 and 134 are different, position error between colors may be represented by the following Equation 3.

$$X1=\delta Xo2/Vb+\delta\theta 1/W1-\delta\theta 2/W2$$

$$X2=\delta Xo3/Vb+\delta\theta 1/W1-\delta\theta 3/W3$$

$$X3=\delta Xo4/Vb+\delta\theta 1/W1-\delta\theta 4/W4 \qquad \text{Equation 3}$$

X1, X2, and X3 are respectively time values that denote position error of a second color with respect to a first color, position error of a third color with respect to the first color, and position error of a fourth color with respect to the first color.

Referring to Equation 2 and Equation 3, X1, X2 and X3 may be acquired using Y4 to Y7, which are measured values. A relationship therebetween may be represented by the following Equation 4, and fixed errors calculated by the pre ACR unit 162 are X1, X2 and X3.

$$X1=Y4-Y5$$

$$X2=Y4-Y6$$

$$X3=Y4-Y7 \qquad \text{Equation 4}$$

Additionally, X4 to X7 may be represented by the following Equation 5, and a relationship between X1 to X7 and Y1 to Y7 may be represented by a determinant of the following Equation 6.

$$\begin{aligned} X4 &= \delta Xs1/Vb+\delta\theta 1/W1 \\ X5 &= (\delta Xs2-\delta Xo2)/Vb+\delta\theta 2/W2 \\ X6 &= (\delta Xs3-\delta Xo3)/Vb+\delta\theta 3/W3 \\ X7 &= (\delta Xs4-\delta Xo4)/Vb+\delta\theta 4/W4 \end{aligned} \qquad \text{Equation 5}$$

$$\begin{bmatrix} X_1 \\ X_2 \\ X_3 \\ X_4 \\ X_5 \\ X_6 \\ X_7 \end{bmatrix} = A \begin{bmatrix} Y_1 \\ Y_2 \\ Y_3 \\ Y_4 \\ Y_5 \\ Y_6 \\ Y_7 \end{bmatrix}, \qquad \text{Equation 6}$$

$$A = \begin{bmatrix} 0 & 0 & 0 & 1 & -1 & 0 & 0 \\ 0 & 0 & 0 & 1 & 0 & -1 & 0 \\ 0 & 0 & 0 & 1 & 0 & 0 & -1 \\ 1 & 0 & 0 & 0 & 0 & 0 & 0 \\ 0 & 1 & 0 & -1 & 1 & 0 & 0 \\ 0 & 0 & 1 & -1 & 0 & 1 & 0 \\ 0 & 0 & 0 & 0 & 0 & 0 & 1 \end{bmatrix}$$

In the above description, to calculate fixed errors by the pre ACR unit 162, it may be necessary to measure times PT14, PT24, PT34 and PT44 taken until each of the first-color pre-test pattern PP1 to the fourth-color pre-test pattern PP4 reaches the fourth sensing unit 154, and to calculate design times T14, T24, T34 and T44 associated therewith.

The pre ACR unit 162 may implement calculation required for acquisition of fixed errors among calculations represented in the above Equations, and the sensing unit 150 may measure only required time. However, with regard to main ACR that will be implemented later, the sensing unit 150 also measures time PT11 taken until the first-color pre-test pattern reaches the first sensing unit 151, time PT22 taken until the second-color pre-test pattern reaches the second sensing unit 152, and time PT33 taken until the third-color pre-test pattern reaches the third sensing unit 153.

Figure 6:
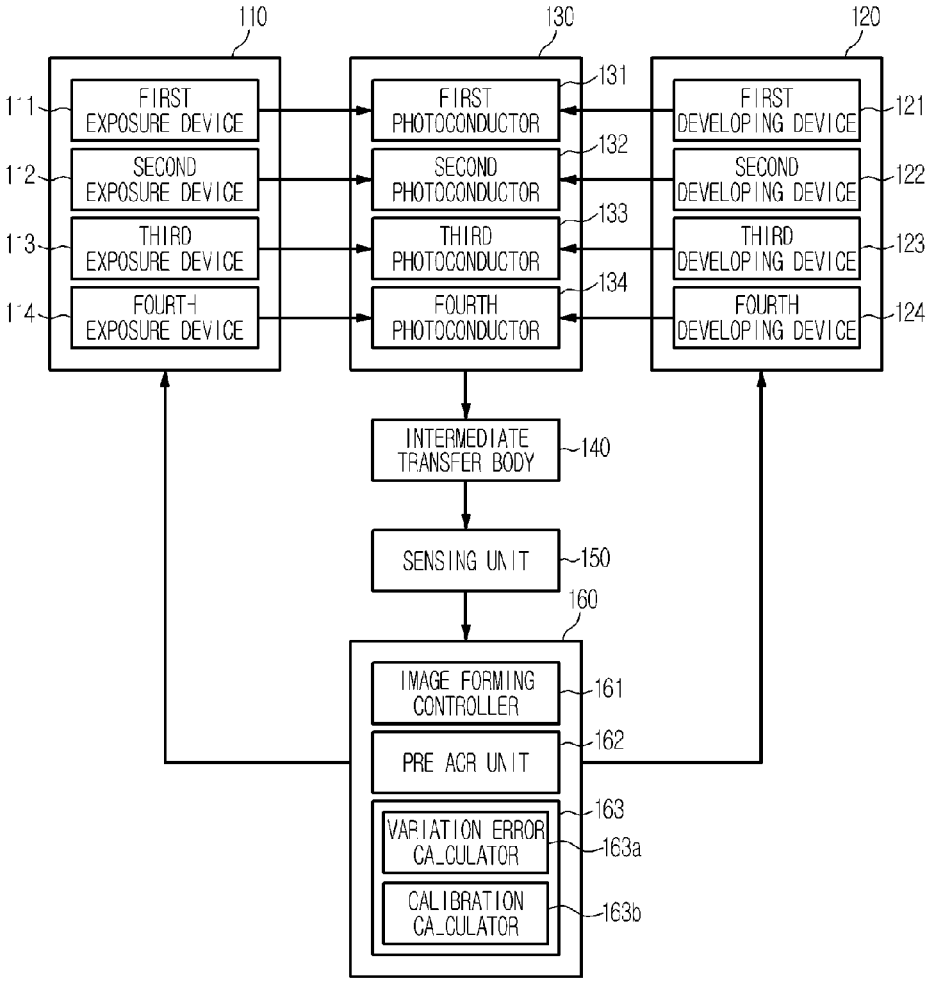
FIG. 6 is a control block diagram of a main ACR unit.
Figure 7A:
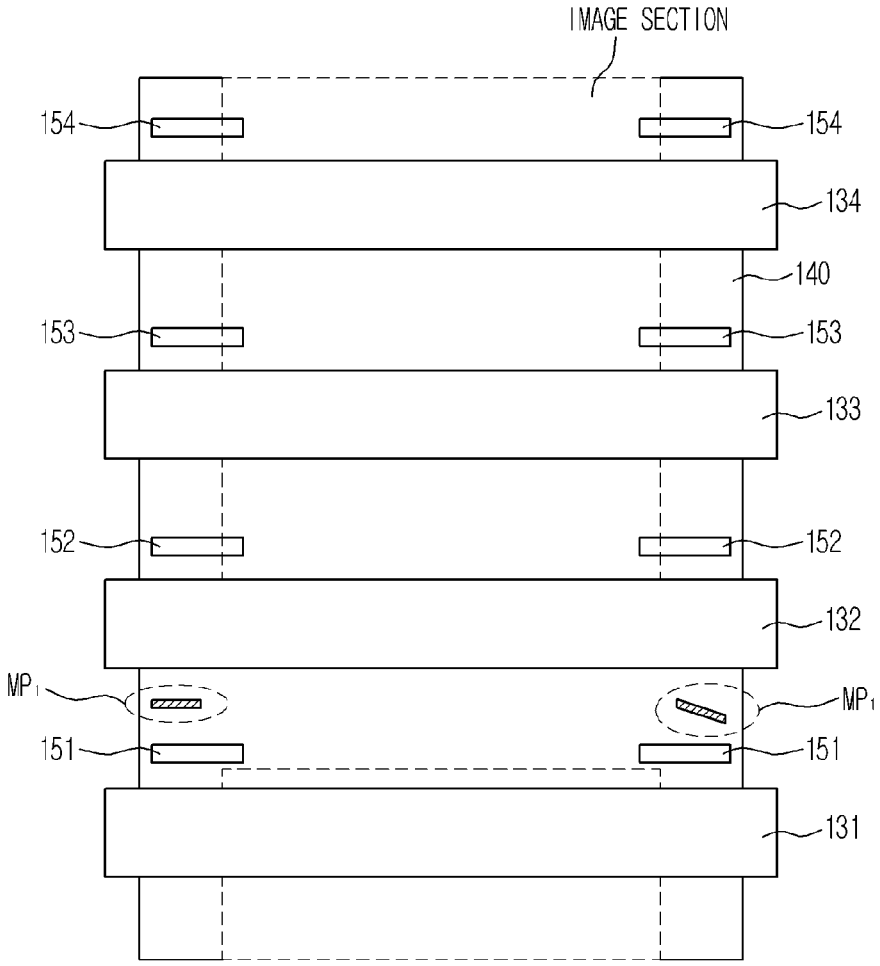
FIGS. 7A to 7C are views showing main-test patterns transferred to the intermediate transfer body.
Figure 7B:
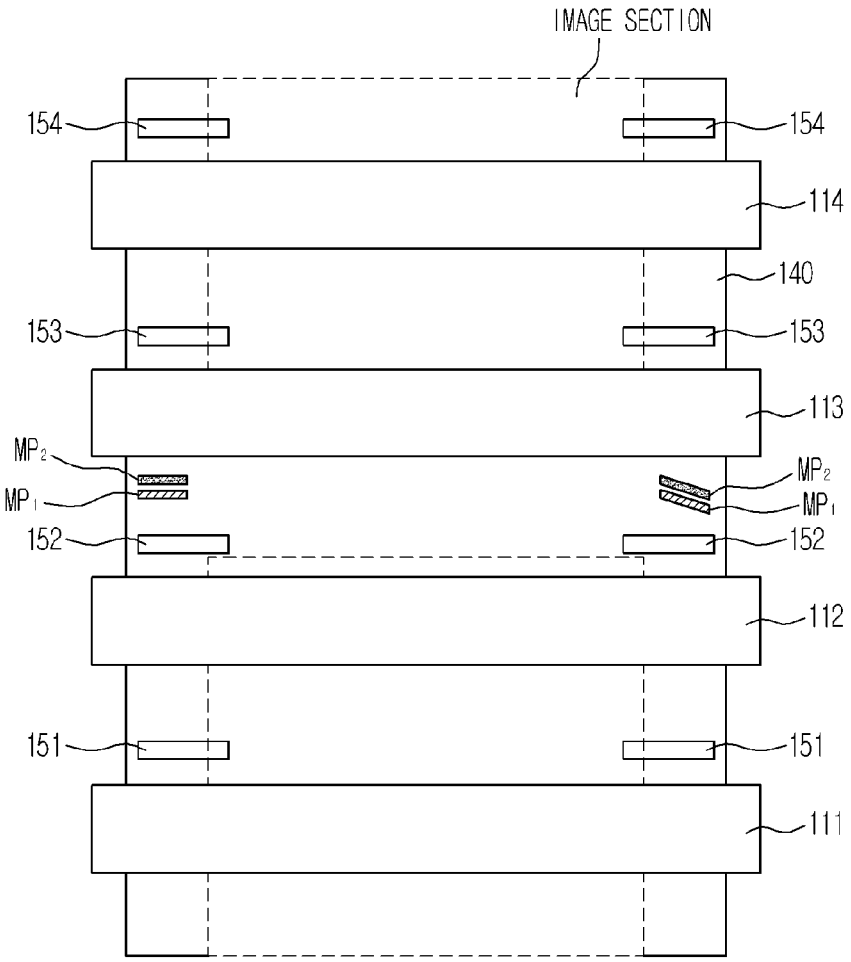
Figure 7C:
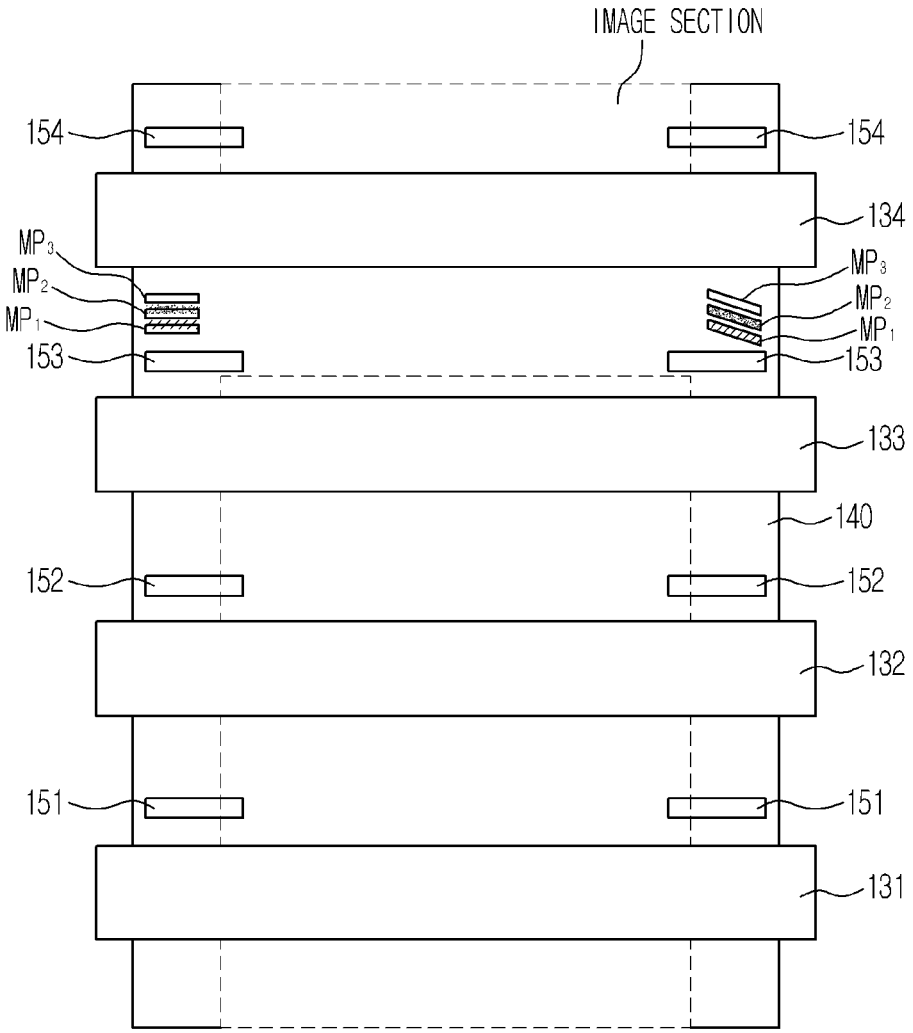

Then, if a printing instruction is input, the main ACR unit 163 implements main ACR as well as printing. FIG. 6 is a control block diagram of the main ACR unit, and FIGS. 7A to 7C are views showing main-test patterns transferred to the intermediate transfer body. FIGS. 7A to 7C show the intermediate transfer body 140 when viewed in a direction perpendicular to a surface of the intermediate transfer body 140.

During printing, in addition to fixed errors that are caused by, e.g., change in the velocity of the intermediate transfer body 140 depending on the amount of toner consumed for image formation or temperature increase within the apparatus and calculated via pre ACR, variation error may additionally occur. Referring to FIG. 6, the main ACR unit 163 includes a variation error calculator 163*a* to calculate variation error and a calibration calculator 163*b* to calculate the calibration of exposure time using variation error and fixed error.

If a printing instruction is input, the image forming controller 161 controls transfer of a main-test pattern to a non-image section of the intermediate transfer body 140 as exemplarily shown in FIGS. 7A to 7C while controlling printing. The non-image section refers to a section where an image is not formed. The non-image section may be a blank between image forming sections, or may be a region around an image forming section having a predetermined width. That is, in an embodiment, the entire region of the surface of the intermediate transfer body 140 except for the image forming section may be the non-image section.

First, as exemplarily shown in FIG. 7A, if a first-color main-test pattern MP1 is transferred to the intermediate transfer body 140, the first sensing unit 151 senses the pattern and measures time MT11 taken from exposure to sensing of the pattern. The variation error calculator 163*a* calculates a difference between the measured time MT11 and the time PT11 measured via pre ACR, i.e. variation error Z1. Then, the calibration calculator 163*b* calculates a calibration value by summing the fixed error X1 calculated via pre ACR and the variation error Z1, and the image forming controller 161 adjusts the exposure time of a second color based on the calculated calibration value. In this case, exposure to form a second-color main-test pattern MP2 (see FIG. 7B) is implemented simultaneously with exposure for printing.

As exemplarily shown in FIG. 7B, if the second-color main-test pattern MP2 is transferred to the intermediate transfer body 140, the second sensing unit 152 senses the pattern and measures time MT22 taken from exposure to sensing of the pattern. The variation error calculator 163*a* calculates a difference between the measured time MT22 and the time PT22 measured via pre ACR, i.e. variation error Z2. Then, the calibration calculator 163*b* calculates a calibration value by summing the fixed error X2 calculated via pre ACR and the variation error Z2, and the image forming controller 161 adjusts the exposure time of a third color based on the calculated calibration value. Alternatively, an average value of the variation error Z1 of a first color and the variation error Z2 of a second color, or the sum thereof to which a weighting value is applied may be added to the fixed error X2.

As exemplarily shown in FIG. 7C, if a third-color main-test pattern MP3 is transferred to the intermediate transfer body 140, the third sensing unit 153 senses the pattern and measures time MT33 taken from exposure to sensing of the pattern. The variation error calculator 163*a* calculates a difference between the measured time MT33 and the time PT33 measured via pre ACR, i.e. variation error Z3. Then, the calibration calculator 163*b* calculates a calibration value by summing the fixed error X3 calculated via pre ACR and the variation error Z3, and the image forming controller 161 adjusts the exposure time of a fourth color based on the calculated calibration value. Alternatively, an average value of the variation error Z1 of a first color, the variation error Z2 of a second color, and the variation error Z3 of a third color, or the sum thereof to which a weighting value is applied may be added to the fixed error X3.

A detailed embodiment with regard to implementation of ACR by the image forming apparatus 100 will be described based on the above description.

Conditions of mechanical components equipped in the image forming apparatus 100 according to the present embodiment will be assumed as follows. A diameter d of the first photoconductor 131 to the fourth photoconductor 134 is 30 mm, an angular velocity w of the first photoconductor 131 to the fourth photoconductor 134 is 6.7 rad/s (64 rpm), a linear velocity Vb of the intermediate transfer body 140 is 100 mm/s, and a design distance between rotational centers of the respective photoconductors is 73 mm.

However, considering real distances between the rotational centers of the photoconductors, it is assumed that a distance Xo2 between the rotational center of the first photoconductor 131 and the rotational center of the second photoconductor 132 is 73.3 mm, a distance Xo3 between the rotational center of the first photoconductor 131 and the rotational center of the third photoconductor 133 is 146.2 mm, and a distance Xo4 between the rotational center of the first photoconductor 131 and the rotational center of the fourth photoconductor 134 is 219.5 mm.

In addition, a design distance Xs1 from the rotational center of the first photoconductor 131 to the first sensing unit 151 is 30 mm, a design distance Xs2 from the rotational center of the first photoconductor 131 to the second sensing unit 152 is 108 mm, a design distance Xs3 from the rotational center of the first photoconductor 131 to the third sensing unit 153 is 186 mm, and a design distance Xs4 from the rotational center of the first photoconductor 131 to the fourth sensing unit 154 is 264 mm.

In an embodiment, it is assumed that a distance error δXs1 from the rotational center of the first photoconductor 131 to the first sensing unit 151 is 0.1 mm, a distance error δXs2 from the rotational center of the first photoconductor 131 to the second sensing unit 152 is −0.1 mm, a distance error δXs3 from the rotational center of the first photoconductor 131 to the third sensing unit 153 is 0.2 mm, and a distance error δXs4 from the rotational center of the first photoconductor 131 to the fourth sensing unit 154 is −0.2 mm.

In addition, a design angle θ between the exposure position of each photoconductor 131, 132, 133 or 134 and the transfer position on the intermediate transfer body 140 is 2.5 rad.

In an embodiment, it is assumed that a shift degree of the exposure position of the first photoconductor 131, i.e. exposure position error δθ1 is 0.01 rad, exposure position error δθ2 of the second photoconductor 132 is 0.00 rad, exposure position error δθ3 of the third photoconductor 133 is −0.02 rad, and exposure position error δθ4 of the fourth photoconductor 134 is 0.03 rad.

The image forming controller 161 transfers the pre-test patterns to the intermediate transfer body 140, and the first sensing unit 151 to the fourth sensing unit 154 measure time PTij by sensing the pre-test patterns of respective colors. Through estimation using Equation 1 and Equation 2, real measured time PTij may be PT11=675.6 ms, PT14=3012.6 ms, PT24=2278.1 ms, PT34=1546.1 ms, PT44=820.6 ms, PT22=719.1 ms, and PT33=770.1 ms.

The pre ACR unit 162 may calculate design time Tij based on Equation 1, and the calculated design time Tij is T11=673.1 ms, T14=3013.1 ms, T24=2283.1 ms, T34=1553.1 ms, T44=823.1 ms, T22=723.1 ms, and T33=773.1 ms.

The pre ACR unit 162 calculates a difference between the measured time PTij and the design time Tij. The calculated difference is Y4=−0.5 ms, Y5=−5.0 ms, Y6=−7.0 ms, and Y7=−2.5 ms. The pre ACR unit 162 calculates fixed error by substituting the calculated difference into Equation 4. The calculated fixed error is X1=4.5 ms, X2=6.5 ms, and X3=2.0 ms.

The pre ACR is completed once the fixed error is calculated, and the image forming apparatus enters printing standby. Then, if a printing instruction is input, main ACR as well as printing are implemented. If the image forming apparatus 161 transfers the first-color main-test pattern MP1 to a non-image section of the intermediate transfer body 140, the first sensing unit 151 senses the transferred first-color main-test pattern MP1, and measures time MT11 taken from exposure to sensing of the pattern.

The measured time MT11 may be different from the time PT11 measured via pre ACR due to temperature variation within the image forming apparatus 100, external shock, etc. Assuming that the measured time MT11 is 673.6 ms, the first variation error Z1 calculated by the variation error calculator 163*a* is −2 ms that is acquired by subtracting the time MT11 measured via main ACR from the time PT11 measured via pre ACR.

The calibration calculator 163*b* calculates a calibration value by summing the fixed error of a second color X1 with respect to the first color and the first variation error Z1 to thereby acquire a value of 2.5 ms, and the image forming controller 161 delays exposure time of the second color by 2.5 ms.

If the image forming controller 161 transfers the second-color main-test pattern MP2 to the non-image section of the intermediate transfer body 140, the second sensing unit 152 senses the second-color main-test pattern MP2, and measures time MT22 taken from exposure to sensing of the pattern. If the measured time MT22 is 716.9 ms, the second variation error Z2 calculated by the variation error calculator 163*a* is −2.2 ms and the calibration value calculated by the calibration calculator 163*b* is 35.5 ms that is acquired by summing the fixed error of a third color X2 with respect to the first color and the second variation error Z2. The image forming controller 161 delays exposure time of the third color by 4.3 ms.

If the image forming controller 161 transfers the third-color main-test pattern MP3 to the non-image section of the intermediate transfer body 140, the third sensing unit 153 senses the third-color main-test pattern MP3, and measures time MT33 taken from exposure to sensing of the pattern. If the measured time MT33 is 763.1 ms, the third variation error Z3 calculated by the variation error calculator 163*a* is −7.0 ms and the calibration value calculated by the calibration calculator 163*b* is −5.0 ms that is acquired by summing the fixed error of a fourth color X3 with respect to the first color and the third variation error Z3. The image forming controller 161 delays exposure time of the fourth color by 5.0 ms.

The main ACR unit 163 may implement the above-described main ACR whenever printing is implemented and exposure of each color may be calibrated in real time, which may prevent color shift.

Figure 8:
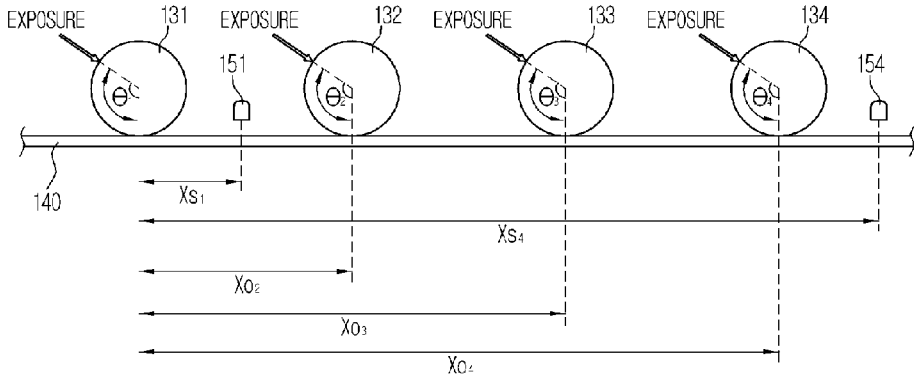
FIG. 8 is a view showing arrangement of sensing units in the case in which the image forming apparatus is equipped with two sensing units.
Figure 9A:
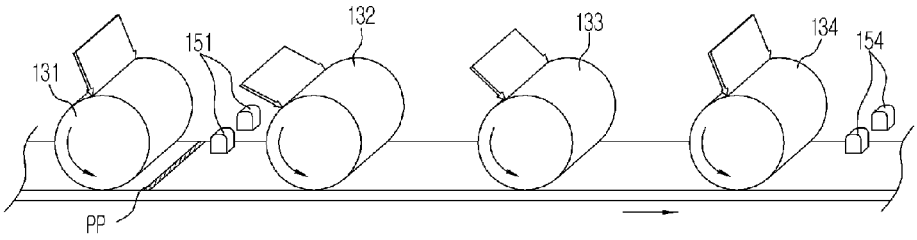
FIGS. 9A to 9D are views showing pre-test patterns transferred to the intermediate transfer body via pre ACR.
Figure 9B:
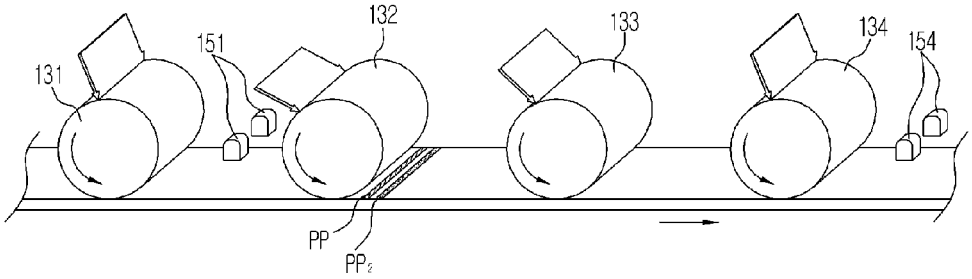
Figure 9C:
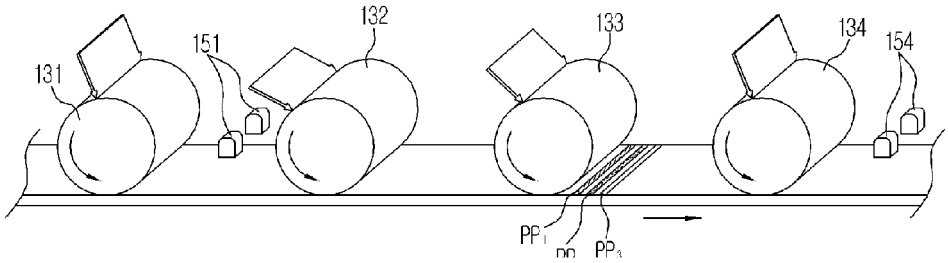
Figure 9D:
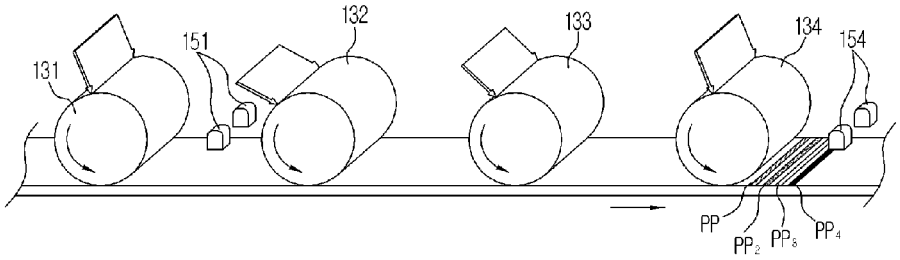

FIG. 8 is a view showing arrangement of sensing units in the case in which the image forming apparatus is equipped with two sensing units.

Although the above-described embodiment exemplifies that the sensing units are arranged on a per photoconductor basis, it may be possible to calculate only variation error Z1 of a first color upon implementation of main ACR if position shifts of respective colors consecutively occur. Accordingly, as exemplarily shown in FIG. 8, it may be possible to control exposure time via implementation of pre ACR and main ACR even if only the first sensing unit 151 and the fourth sensing unit 154 are provided.

FIGS. 9A to 9D are views showing pre-test patterns transferred to the intermediate transfer body via pre ACR.

Referring to FIGS. 9A to 9D, even in the case in which the second sensing unit 152 and the third sensing unit 153 are omitted, all of the first-color pre-test pattern to the fourth-color pre-test pattern may be transferred to the intermediate transfer body 140. Time PT11 taken until the first-color pre-test pattern PP1 reaches the first sensing unit 151 after exposure thereof and time PT14 taken until the first-color pre-test pattern PP1 reaches the fourth sensing unit 154 after exposure thereof are measured. In addition, time PT24 taken until the second-color pre-test pattern PP2 reaches the fourth sensing unit 154 after exposure thereof, time PT34 taken until the third-color pre-test pattern PP3 reaches the fourth sensing unit 154 after exposure thereof, and time PT44 taken until the fourth-color pre-test pattern PP4 reaches the fourth sensing unit 154 after exposure thereof are measured.

Referring again to FIG. 8, the distance from the rotational center of the first photoconductor 131 to the rotational center of the second photoconductor 132 is designated by Xo2, the distance from the rotational center of the first photoconductor 131 to the rotational center of the third photoconductor 133 is designated by Xo3, and the distance from the rotational center of the first photoconductor 131 to the rotational center of the fourth photoconductor 134 is designated by Xo4.

The distance from the rotational center of the first photoconductor 131 to the first sensing unit 151 is designated by Xs1, and the distance from the rotational center of the first photoconductor 131 to the fourth sensing unit 154 is designated by Xs4.

Calculation of the fixed errors X1, X2 and X3 by the pre ACR unit 162 is implemented using Equation 1 to Equation 4 as described above. Briefly, first, reference time Tij as a design value is calculated using Equation 1. Then, a difference between the measured time PTij and the reference time Tij is calculated using Equation 2. In the present embodiment, the second sensing unit and the third sensing unit are not used, and therefore Y4 to Y7 may be calculated. When substituting Y4 to Y7 into Equation 4, fixed error of a second color X1, fixed error of a third color X2, and fixed error of a fourth color X3 with respect to a first color may be calculated.

Then, if a printing instruction is input, the main ACR unit 163 implements main ACR as well as printing. In the case in which the image forming apparatus 100 includes the first sensing unit 151 and the fourth sensing unit 154 as in the embodiment of FIG. 8, the image forming controller 161 controls transfer of the first-color main-test pattern to the non-image section of the intermediate transfer body 140 in response to the input printing instruction.

Figure 10:
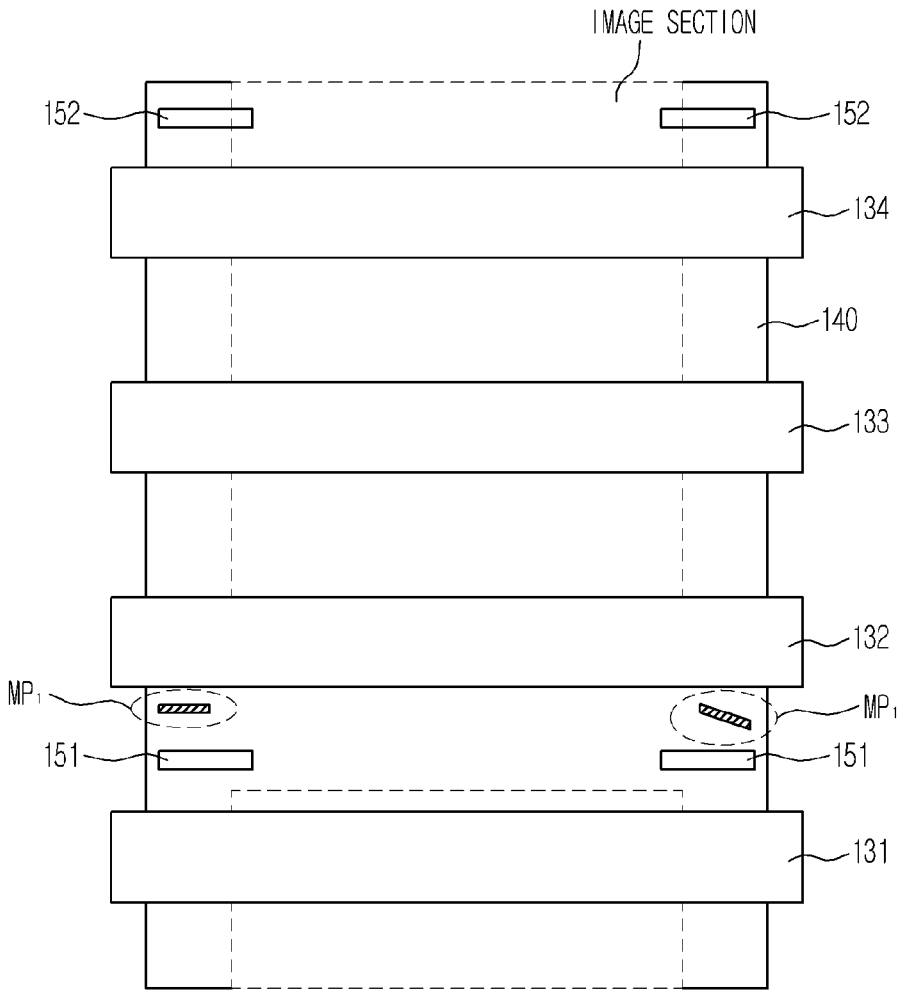
FIG. 10 is a view showing main-test patterns transferred to the intermediate transfer body.

FIG. 10 is a view showing main-test patterns transferred to the intermediate transfer body. More specifically, FIG. 10 shows the intermediate transfer body 140 when viewed in a direction perpendicular to the surface of the intermediate transfer body 140.

In an embodiment, even if only the first-color main-test pattern MP1 is transferred to the intermediate transfer body 140, main ACR may be implemented.

More specifically, if the first-color main-test pattern MP1 is transferred to the intermediate transfer body 140, the first sensing unit 151 senses the first-color main-test pattern MP1, and measures time MT11 taken after exposure to sensing of the pattern. The variation error calculator 163*a* calculates a difference between the time PT11 measured via pre ACR and the time MT11 measured via main ACR. The difference is the variation error Z1.

Then, the calibration calculator 163*b* calculates a calibration value by summing the variation error Z1 and the fixed error of each color. That is, a calibration value for a second color is X1+Z1, a calibration value for a third color is X2+Z1, and a calibration value for a fourth color is X3+Z1. That is, after exposure of a first color, the main ACR unit 163 calculates the calibration values for following colors, i.e. the second color, the third color and the fourth color, and controls exposure time based on the calculated calibration values upon exposure of the second color, the third color and the fourth color. Exposure of the second color is delayed by X1+Z1, exposure of the third color is delayed by X2+Z1, and exposure of the fourth color is delayed by X3+Z1. If the calibration value has a positive value, this may indicate implementation of exposure delay. If the calibration value has a negative value, this may indicate implementation of early exposure. On the other hand, a negative calibration value may indicate implementation of exposure delay and a positive calibration value may indicate implementation of early exposure when the criterion of a numerical value is set in reverse.

A detailed embodiment with regard to implementation of ACR by the image forming apparatus 100 equipped with two sensing units will be described based on the above description.

Conditions of mechanical components equipped in the image forming apparatus 100 according to the present embodiment will be assumed as follows. A diameter d of the first photoconductor 131 to the fourth photoconductor 134 is 30 mm, an angular velocity w of the first photoconductor 131 to the fourth photoconductor 134 is 6.7 rad/s (64 rpm), a linear velocity Vb of the intermediate transfer body 140 is 100 mm/s, and a design distance between rotational centers of the respective photoconductors is 73 mm.

However, considering real distances between the rotational centers of the photoconductors, it is assumed that a distance Xo2 between the rotational center of the first photoconductor 131 and the rotational center of the second photoconductor 132 is 73.3 mm, a distance Xo3 between the rotational center of the first photoconductor 131 and the rotational center of the third photoconductor 133 is 146.2 mm, and a distance Xo4 between the rotational center of the first photoconductor 131 and the rotational center of the fourth photoconductor 134 is 219.5 mm.

In addition, a design distance Xs1 from the rotational center of the first photoconductor 131 to the first sensing unit 151 is 30 mm, and a design distance Xs4 from the rotational center of the first photoconductor 131 to the fourth sensing unit 154 is 264 mm.

In an embodiment, it is assumed that a distance error δXs1 from the rotational center of the first photoconductor 131 to the first sensing unit 151 is 0.1 mm, and a distance error δXs4 from the rotational center of the first photoconductor 131 to the fourth sensing unit 154 is −0.2 mm.

In addition, a design angle θ between the exposure position of each photoconductor 131, 132, 133 or 134 and the transfer position on the intermediate transfer body 140 is 2.5 rad.

In an embodiment, it is assumed that a shift degree of the exposure position of the first photoconductor 131, i.e. exposure position error δθ1 is 0.01 rad, exposure position error δθ2 of the second photoconductor 132 is 0.00 rad, exposure position error δθ3 of the third photoconductor 133 is −0.02 rad, and exposure position error δθ4 of the fourth photoconductor 134 is 0.03 rad.

The pre ACR may be implemented when components mounted in the image forming apparatus 100 may exhibit errors, such as, for example, when manufacture of the image forming apparatus 100 is completed, when components of the image forming apparatus 100 are replaced, or when external shock is applied. To this end, the image forming controller 161 transfers the pre-test patterns to the intermediate transfer body 140, and the first sensing unit 151 and the fourth sensing unit 154 measure time PTij by sensing the pre-test patterns of respective colors.

Through estimation using Equation 1 and Equation 2, the real measured time PTij may be PT11=675.6 ms, PT14=3012.6 ms, PT24=2278.1 ms, PT34=1546.1 ms, and PT44=820.6 ms.

The pre ACR unit 162 may calculate design time Tij based on Equation 1, and the calculated design time Tij is T11=673.1 ms, T14=3013.1 ms, T24=2283.1 ms, T34=1553.1 ms, and T44=823.1 ms.

The pre ACR unit 162 calculates a difference between the measured time PTij and the design time Tij. The calculated difference is Y4=−0.5 ms, Y5=−5.0 ms, Y6=−7.0 ms, and Y7=−2.5 ms. The pre ACR unit 162 calculates fixed error by substituting the calculated difference into Equation 4. The calculated fixed error is X1=4.5 ms, X2=6.5 ms, and X3=2.0 ms.

Pre ACR is completed once the fixed error is calculated, and the image forming apparatus enters printing standby. Then, if a printing instruction is input, main ACR as well as printing are implemented. If the image forming apparatus 161 transfers the first-color main-test pattern MP1 to the non-image section of the intermediate transfer body 140, the first sensing unit 151 senses the transferred first-color main-test pattern MP1, and measures time MT11 taken from exposure to sensing of the pattern.

The measured time MT11 may be different from the time PT11 measured via pre ACR due to temperature variation within the image forming apparatus 100, external shock, etc. Assuming that the measured time MT11 is 673.6 ms, the first variation error Z1 calculated by the variation error calculator 163*a* is −2 ms that is acquired by subtracting the time MT11 measured via main ACR from the time PT11 measured via pre ACR.

The calibration calculator 163*b* calculates calibration values of 2.5 ms, 4.5 ms, and 0.0 ms by summing the fixed errors X1, X2 and X3 and the variation error Z1. The image forming controller 161 delays exposure time of the second color by 2.5 ms and exposure time of the third color by 4.5 ms, but controls exposure of the fourth color without adjustment.

The main ACR unit 163 may implement the above-described main ACR whenever printing is implemented and exposure time of each color may be calibrated whenever printed paper is output, which may prevent color shift.

An embodiment with regard to a control method for the image forming apparatus according to an aspect of an embodiment will be described.

Figure 11:
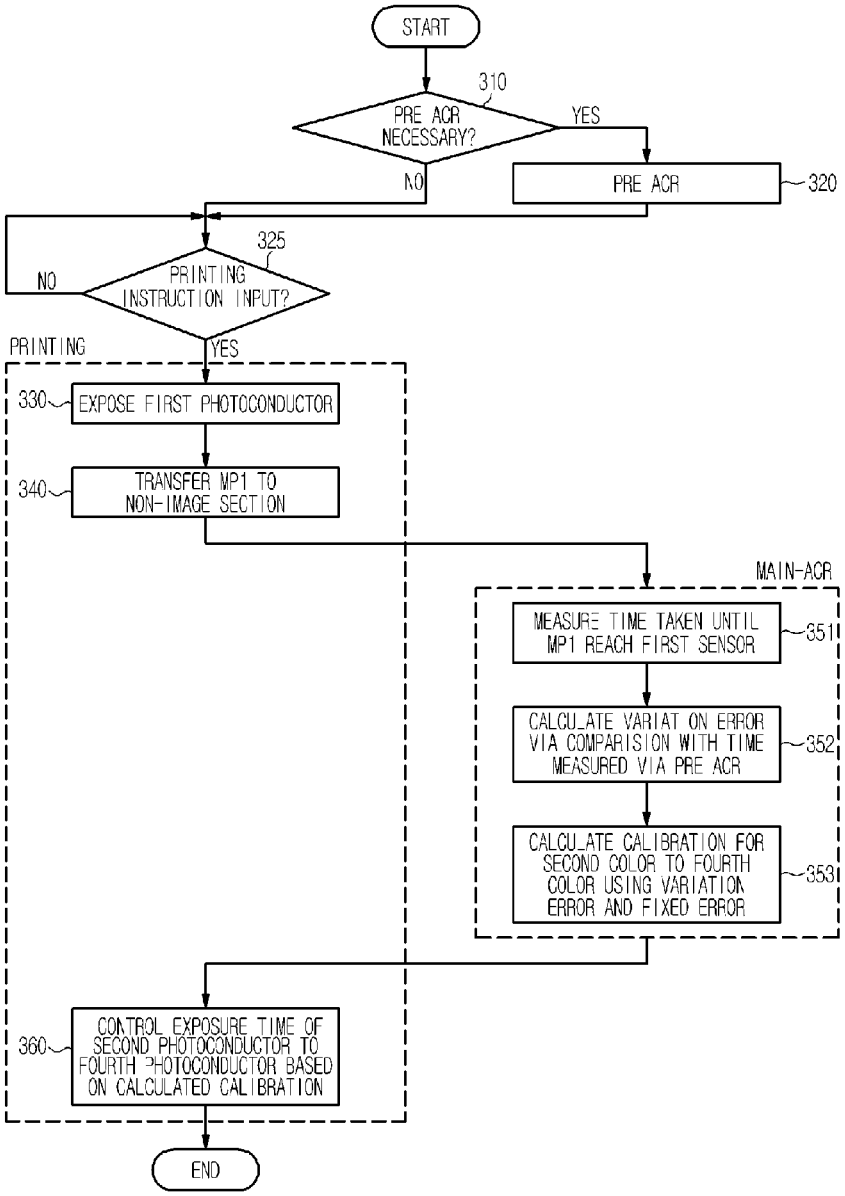
FIG. 11 is a flowchart showing a control method for an image forming apparatus according to an embodiment.

FIG. 11 is a flowchart showing a control method for an image forming apparatus according to an embodiment. In an embodiment the image forming apparatus may include a first sensing unit placed between a first photoconductor and a second photoconductor and a second sensing unit downstream of a fourth photoconductor.

Referring to FIG. 11, first, whether or not pre ACR is necessary is judged (310). When it is expected that variation in the installation positions of components occur, such as, for example, when manufacture of the image forming apparatus is completed, when components, such as the photoconductor, the intermediate transfer body, the developing unit, the exposure unit, etc., are replaced, or when external shock is applied, it may be judged that pre ACR is necessary to calculate fixed error.

If it is judged that pre ACR is necessary (Yes in 310), pre ACR is implemented to calculate fixed error (320). A detailed description of pre ACR will be described later with reference to FIG. 12.

If a printing instruction is input (Yes in 325), main ACR is implemented simultaneously with printing, and exposure of the first photoconductor begins (330). In this case, the first-color main-test pattern MP1 is transferred to the non-image section (340). The non-image section may be a blank between neighboring sheets of paper, or may be a region around a sheet of paper having a predetermined width.

The first sensing unit senses the first-color main-test pattern MP1, and measures time MT11 taken until the first-color main-test pattern MP1 reaches the first sensing unit after exposure thereof (351).

Then, variation error is calculated via comparison between the measured time MT11 and time PT11 measured via pre ACR (352). More specifically, the variation error Z1 is a difference between the time PT11 taken until the first-color pre-test pattern PP1 is sensed by the first sensing unit after exposure thereof and the time MT11 taken until the first-color main-test pattern MP1 is sensed by the first sensing unit after exposure thereof.

Calibration values for a second color, a third color and a fourth color are calculated using the variation error and the fixed error (353). More specifically, the calibration value for the second color is calculated by summing fixed error of the second color X1 acquired via pre ACR and the variation error Z1, the calibration value for the third color is calculated by summing fixed error of the third color X2 acquired via pre ACR and the variation error Z1, and the calibration value for the fourth color is calculated by summing fixed error of the fourth color X3 acquired via pre ACR and the variation error Z1.

Exposure times of the second photoconductor to the fourth photoconductor are controlled based on the calculated calibration values (360). If the calibration value has a positive value, this may indicate implementation of exposure delay. If the calibration value has a negative value, this may indicate implementation of early exposure.

Figure 12:
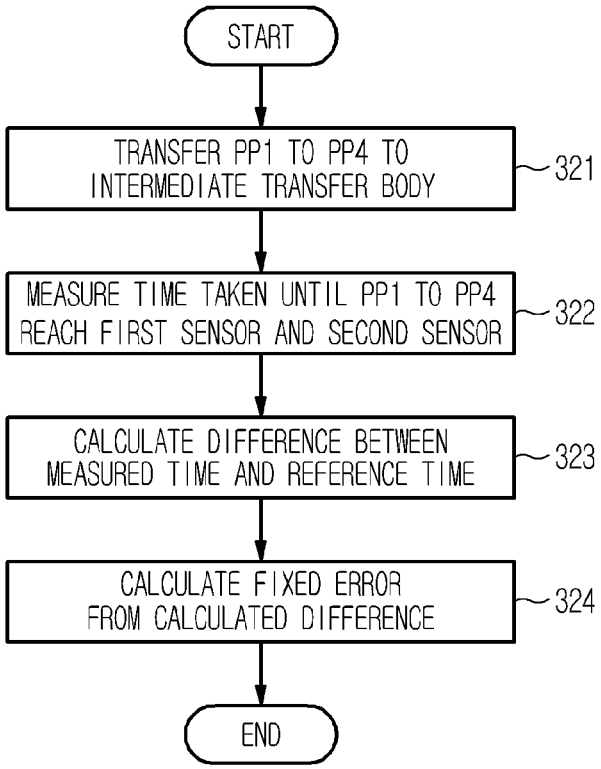
FIG. 12 is a flowchart showing a detailed pre ACR procedure according to an embodiment of FIG. 11.

FIG. 12 is a flowchart showing a detailed pre ACR procedure according to an embodiment of FIG. 11.

Referring to FIG. 12, the first-color pre-test pattern PP1 to the fourth-color pre-test pattern PP4 are transferred to the intermediate transfer body (321). The kind of pre-test patterns is not limited so long as the pre-test pattern may be recognized by the sensing unit.

Time taken until the first-color pre-test pattern PP1 to the fourth-color pre-test pattern PP4 reach the first sensing unit and the second sensing unit is measured (322). More specifically, time PT11 taken until the first-color pre-test pattern PP1 reaches the first sensing unit after exposure thereof and time PT12 taken until the first-color pre-test pattern PP1 reaches the second sensing unit after exposure thereof are measured. In addition, time PT22 taken until the second-color pre-test pattern PP2 reaches the second sensing unit after exposure thereof, time PT32 taken until the third-color pre-test pattern PP3 reaches the second sensing unit after exposure thereof, and time PT42 taken until the fourth-color pre-test pattern PP4 reaches the second sensing unit after exposure thereof are measured. Each measured time is used to calculate the variation error in the above-described operation 352 of FIG. 11.

A difference between the measured time and a reference time is calculated (323). The reference time has a value Tij calculated by applying design values of respective components to Equation 1.

Then, the fixed error is calculated from the calculated difference (324). The fixed error includes time values that denote position error of the second color X1, position error of the third color X2, and position error of the fourth color X3 with respect to the first color. The fixed error may be calculated using Equation 4.

Printing standby begins after pre ACR is completed. If a printing instruction is input, main ACR is implemented using times PT11, PT12, PT22, PT32 and PT42 taken until the pre-test patterns of respective colors are sensed by the first sensing unit and the second sensing unit and the fixed errors X1, X2 and X3.

Although only two sensing units may be provided as in the embodiment of FIGS. 11 and 12, if position shifts of respective colors consecutively occur, the sensing units may be provided on a per photoconductor basis to ensure implementation of real-time calibration on a per color basis.

Figure 13:
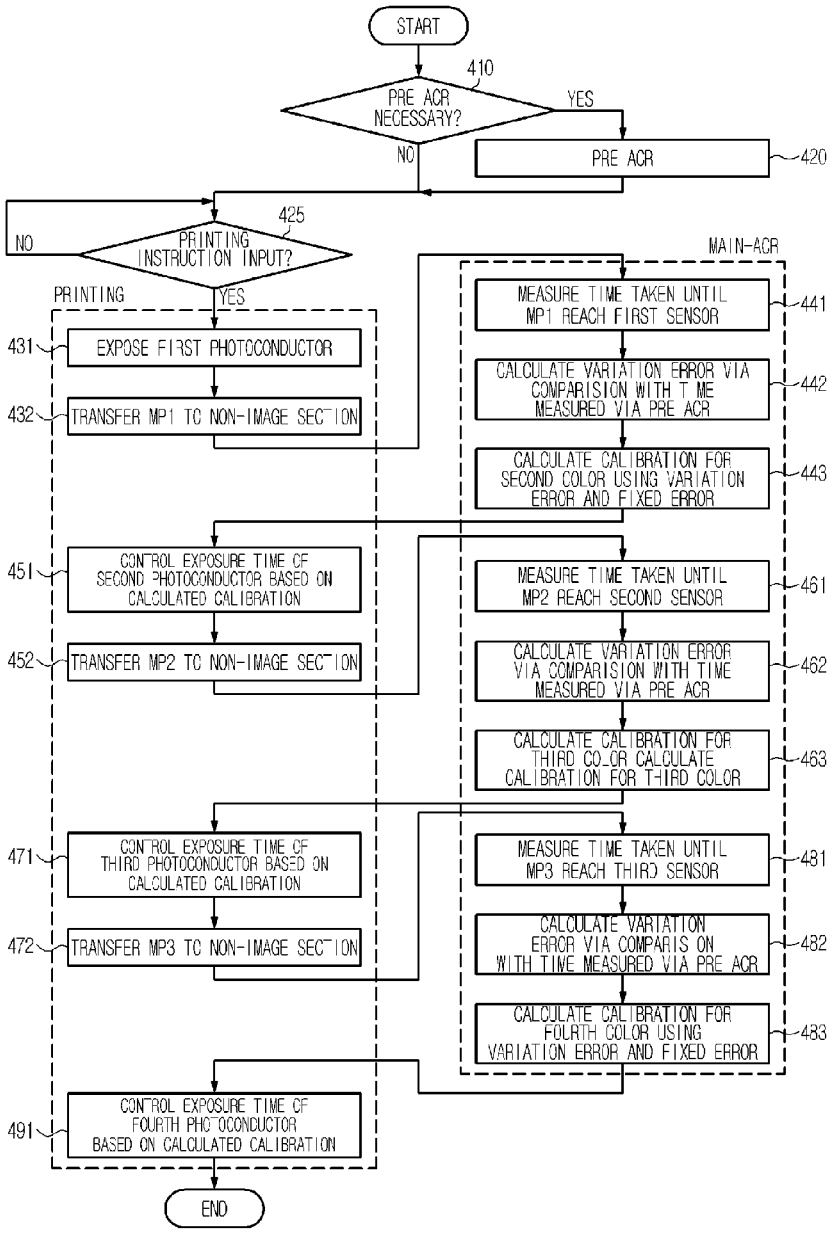
FIG. 13 is a flowchart showing a control method for an image forming apparatus equipped with four sensing units.

FIG. 13 is a flowchart showing a control method for an image forming apparatus equipped with four sensing units. The four sensing units include a first sensing unit between a first photoconductor and a second photoconductor, a second sensing unit between the second photoconductor and a third photoconductor, a third sensing unit between the third photoconductor and a fourth photoconductor, and a fourth sensing unit downstream of the fourth photoconductor.

Referring to FIG. 13, whether or not pre ACR is necessary is judged (410). When it is expected that variation in the installation positions of components occur, such as, for example, when manufacture of the image forming apparatus is completed, when components, such as the photoconductor, the intermediate transfer body, the developing unit, the exposure unit, etc., are replaced, or when external shock is applied, it may be judged that pre ACR is necessary to calculate fixed error.

If it is judged that pre ACR is necessary (Yes in 410), pre ACR is implemented to calculate fixed error (420). A detailed description of pre ACR will be described later.

If a printing instruction is input (Yes in 425), main ACR is implemented simultaneously with printing, and exposure of the first photoconductor begins (431). In this case, the first-color main-test pattern MP1 is transferred to the non-image section (432). The non-image section may be a blank between neighboring sheets of paper, or may be a region around a sheet of paper having a predetermined width.

The first sensing unit senses the first-color main-test pattern MP1, and measures time MT11 taken until the first-color main-test pattern MP1 reaches the first sensing unit after exposure thereof (441).

Then, variation error is calculated via comparison between the measured time MT11 and time PT11 measured via pre ACR (442). More specifically, the variation error Z1 is a difference between the time PT11 taken until the first-color pre-test pattern PP1 is sensed by the first sensing unit after exposure thereof and the time MT11 taken until the first-color main-test pattern MP1 is sensed by the first sensing unit after exposure thereof.

A calibration value for a second color is calculated using the variation error and the fixed error (443). More specifically, the calibration value for the second color may be calculated by summing fixed error of the second color X1 acquired via pre ACR and the variation error Z1.

Then, exposure time of the second photoconductor is controlled based on the calculated calibration value (451). If the calibration value has a positive value, this may indicate implementation of exposure delay. If the calibration value has a negative value, this may indicate implementation of early exposure. The second-color main-test pattern MP2 is transferred to the non-image section (452).

The second sensing unit senses the second-color main-test pattern MP2, and measures time MT22 taken until the second-color main-test pattern MP2 reaches the second sensing unit after exposure thereof (461).

Then, variation error is calculated via comparison between the measured time MT22 and time PT22 measured via pre ACR (462). More specifically, the variation error Z2 is a difference between the time PT22 taken until the second-color pre-test pattern PP2 is sensed by the second sensing unit after exposure thereof and the time MT22 taken until the second-color main-test pattern MP2 is sensed by the second sensing unit after exposure thereof.

A calibration value for a third color is calculated using the variation error and the fixed error (463). More specifically, the calibration value for the third color may be calculated by summing fixed error of the third color X2 acquired via pre ACR and the variation error Z2.

Then, exposure time of the third photoconductor is controlled based on the calculated calibration value (471). If the calibration value has a positive value, this may indicate implementation of exposure delay. If the calibration value has a negative value, this may indicate implementation of early exposure. The third-color main-test pattern MP3 is transferred to the non-image section (472).

The third sensing unit senses the third-color main-test pattern MP3, and measures time MT33 taken until the third-color main-test pattern MP3 reaches the third sensing unit after exposure thereof (481).

Then, variation error is calculated via comparison between the measured time MT33 and time PT33 measured via pre ACR (482). More specifically, the variation error Z3 is a difference between the time PT33 taken until the third-color pre-test pattern PP3 is sensed by the third sensing unit after exposure thereof and the time MT33 taken until the third-color main-test pattern MP3 is sensed by the third sensing unit after exposure thereof.

A calibration value for a fourth color is calculated using the variation error and the fixed error (483). More specifically, the calibration value for the fourth color may be calculated by summing fixed error of the fourth color X3 acquired via pre ACR and the variation error Z3.

Then, exposure time of the fourth photoconductor is controlled based on the calculated calibration value (491). If the calibration value has a positive value, this may indicate implementation of exposure delay. If the calibration value has a negative value, this may indicate implementation of early exposure.

Figure 14:
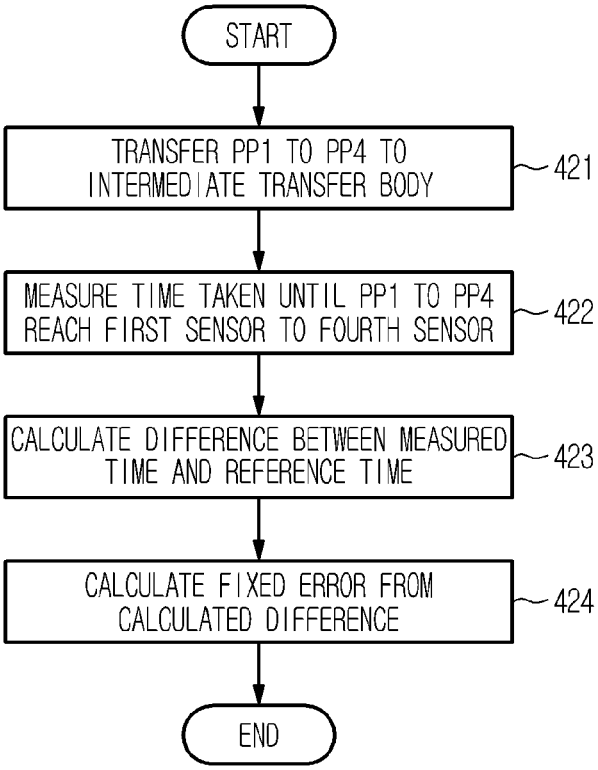
FIG. 14 is a flowchart showing a detailed pre ACR procedure according to an embodiment of FIG. 13.

FIG. 14 is a flowchart showing a detailed pre ACR procedure according to an embodiment of FIG. 13.

Referring to FIG. 14, the first-color pre-test pattern PP1 to the fourth-color pre-test pattern PP4 are transferred to the intermediate transfer body (421). The kind of pre-test patterns is not limited so long as the pre-test pattern may be recognized by the sensing unit.

Time taken until the first-color pre-test pattern PP1 to the fourth-color pre-test pattern PP4 reach the first sensing unit to the fourth sensing unit is measured (422). More specifically, time PT11 taken until the first-color pre-test pattern PP1 reaches the first sensing unit after exposure thereof and time PT12 taken until the first-color pre-test pattern PP1 reaches the second sensing unit 132 after exposure thereof are measured. In addition, time PT22 taken until the second-color pre-test pattern PP2 reaches the second sensing unit after exposure thereof and time PT24 taken until the second-color pre-test pattern PP2 reaches the fourth sensing unit after exposure thereof are measured. Time PT33 taken until the third-color pre-test pattern PP3 reaches the third sensing unit after exposure thereof and time PT34 taken until the third-color pre-test pattern PP3 reaches the fourth sensing unit after exposure thereof are measured. Time PT44 taken until the fourth-color pre-test pattern PP4 reaches the fourth sensing unit after exposure thereof is measured. Among the measured times, the times PT11, PT22, PT33 and PT44 are used to calculate the variation error in the above-described embodiment of FIG. 14.

A difference between the measured time and a reference time is calculated (423). The reference time has a value Tij calculated by applying design values of respective components to Equation 1.

Then, the fixed error is calculated from the calculated difference (424). The fixed error includes time values that denote position error of the second color X1, position error of the third color X2, and position error of the fourth color X3 with respect to the first color. The fixed error may be calculated using Equation 4.

Printing standby begins after pre ACR is completed. If a printing instruction is input, main ACR is implemented using times PT11, PT14, PT24, PT34 and PT44 taken until the pre-test patterns of respective colors are sensed by the first sensing unit to the fourth sensing unit and the fixed errors X1, X2 and X3. The main ACR may be implemented whenever an image is output, and color position calibration may be implemented in real time.

Figure 15:
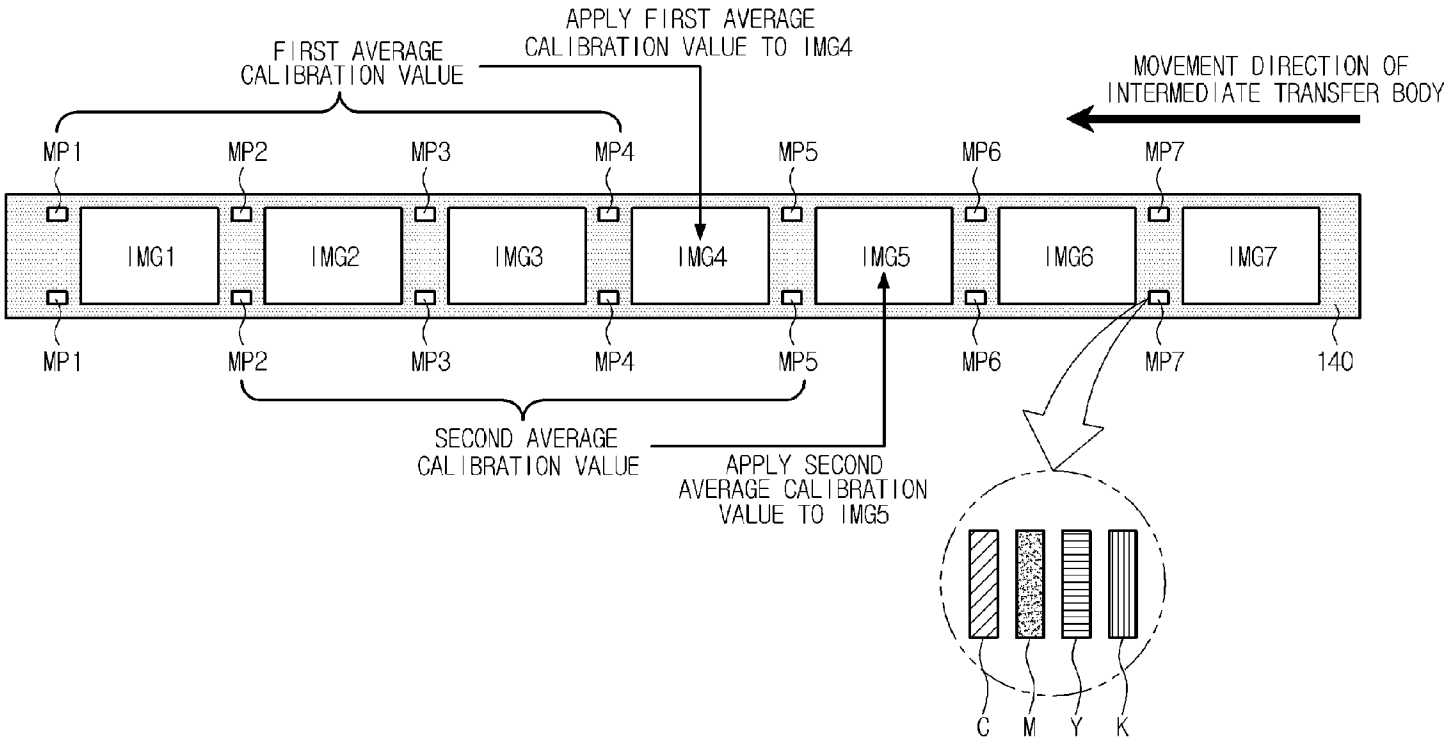
FIG. 15 is an explanatory view of a real-time ACR procedure of the image forming apparatus according to an embodiment.

FIG. 15 is an explanatory view of a real-time ACR procedure of the image forming apparatus according to an embodiment. FIG. 15 shows the intermediate transfer body 140 when viewed in a direction perpendicular to the surface of the intermediate transfer body 140. As exemplarily shown in FIG. 15, if a printing instruction is input, the image forming controller 161 controls transfer of main-test pattern sets MP1 to MP7 to a non-image section of the intermediate transfer body 140 while controlling printing. The non-image section may be a section where an image is not formed (transferred). The non-image section may be a blank between the neighboring image forming sections IMG1 to IMG7, or may be a region around each of the image forming sections IMG1 to IMG7 having a predetermined width. That is, in an embodiment, the entire region of the surface of the intermediate transfer body 140 except for the image forming sections IMG1 to IMG7 may be the non-image section. In general, the blank between the neighboring image forming sections IMG1 to IMG7 is called "page break" that refers to "gap between neighboring two pages". In addition, one main-test pattern set mentioned in an embodiment refers to all main-test patterns formed in the blanks between the image forming sections IMG1 to IMG7, i.e. formed in "page breaks". For example, in an embodiment, "all main-test patterns formed between two neighboring image forming sections IMG1 and IMG2" are defined as "one main-test pattern set". If a main-test pattern corresponding to two colors K-Y is formed between two neighboring image forming sections, the main-test pattern of two colors K-Y constitutes one main-test pattern set. In addition, if two main-test patterns of colors K-C-M and of colors K-C-Y are formed between two neighboring image forming sections, the two main-test patterns of colors K-C-M and of colors K-C-Y constitute one main-test pattern set. As such, in the following description, "one main-test pattern set" refers to all main-test patterns formed between two neighboring image forming sections.

In FIG. 15, the sequence of forming the main-test pattern sets MP1 to MP7 and images on the surface of the intermediate transfer body 140 is MP1-IMG1-MP2-IMG2-MP3-IMG3-MP4-IMG4-MP5-IMG5-MP6-IMG6-MP7-IMG7. That is, one main-test pattern set MP1 is formed, and then an image is formed in one image forming section IMG1. Subsequently, another main-test pattern set MP2 is formed, and then an image is formed in another image forming section IMG2. In this case, the number of the main-test pattern sets MP1 to MP7 and the number of images may be greater or less than that shown in FIG. 15 according to the number of pages to be output.

An exposure time calibration value with regard to each of the main-test pattern sets MP1 to MP7 exemplarily shown in FIG. 15 is basically acquired as described above with reference to FIGS. 1 to 14. Note that an average value of exposure time calibration values acquired from some of the plurality of main-test pattern sets MP1 to MP7 may be used when implementing main ACR of an image that will be formed next. For example, as exemplarily shown in FIG. 15, images are formed in the plurality of image forming sections IMG1 to IMG7 of the intermediate transfer body 140, and the main-test pattern sets MP1 to MP7 for color registration are formed in the respective blanks between the neighboring image forming sections IMG1 to IMG7. Color registration calibration is implemented using an average value of color registration calibration values acquired from four main-test pattern sets (e.g., MP1 to MP4 or MP2 to MP5) among the main-test pattern sets MP1 to MP7. In particular, assuming that m is an integer of 1 or more, a first average calibration value may be acquired from an $m^{th}$ main-test pattern set to an $m+3^{rd}$ main-test pattern set to implement color registration calibration for an image in an $m+3^{rd}$ image forming section, and a second average calibration value may be acquired from an $m+1^{st}$ main-test pattern set to an $m+4^{th}$ main-test pattern set to implement color registration calibration for an image in an $m+4^{th}$ image forming section as well as for an $m+5^{th}$ main-test pattern set. That is, a first average calibration value of exposure time calibration values acquired from the respective four main-test pattern sets MP1 to MP4 is calculated, and when forming images in the image forming section IMG4 next to the main-test pattern set MP4 and in the main-test pattern set MP5, main ACR may be implemented on the image of the image forming section IMG4 and the main-test pattern set MP5 using the first average calibration value. Subsequently, a second average calibration value of exposure time calibration values acquired from other four main-test pattern sets MP2 to MP5 is calculated, and when forming images in the image forming section IMG5 next to the main-test pattern set MP5 and in the main-test pattern set MP6, main ACR may be implemented on the image of the image forming section IMG5 and the main-test pattern set MP6 using the second average calibration value. Although FIG. 15 shows only the first average calibration value and the second average calibration value, it will be appreciated that a third average calibration value acquired from the following four main-test pattern sets MP3 to MP6 may be used when forming images in the next image forming section IMG6 and in the main-test pattern set MP7 to implement main ACR on the image of the image forming section IMG6 and the main-test pattern set MP7, and a fourth average calibration value acquired from the following four main-test pattern sets MP4 to MP7 may be used when forming images in the next image forming section IMG7 and in a main-test pattern set MP8 (not shown) to implement main ACR on the image of the image forming section IMG7 and the main-test pattern set MP8 (not shown). To summarize main ACR shown in FIG. 15, main ACR (exposure time calibration for color registration) is implemented on an image of an $i+n-1^{st}$ image forming section and an $i+n^{th}$ main-test pattern set using an average value of color registration calibration values (exposure time calibration values) acquired from an $i^{th}$ main-test pattern set to an $i+n-1^{st}$ main-test pattern set. Here, n is a natural number of 4 or less. The reason why n has a value of 4 or less is as follows.

As exemplarily shown in FIG. 15, with regard to output of a plurality of pages, each position error per color δXmi, δXci, or δXki measured from the $i^{th}$ main-test pattern set are designated by xi (on the basis of yellow). The position error xi includes offset ei and noise ni. The offset ei refers to color offset without considering measurement error, and the noise ni refers to error caused by sensor noise and AC component of each color. That is, the measured color position error xi may be represented by the following Equation 7.

$$x_i = e_i + n_i \qquad \text{Equation 7}$$

When implementing exposure time calibration with respect to respective colors upon output of an $i+1^{st}$ image using an average value of previously acquired exposure time calibration values, an exposure time calibration value Ui may be represented by the following Equation 8.

$$u_i = \frac{1}{j}\sum_{k=i}^{i-j+1} x_k \qquad \text{Equation 8}$$

A real position error of the $i+1^{st}$ image, to which the exposure time calibration value Ui is applied, may be represented by the following Equation 9.

$$e_{i+1} = e_i - u_i \qquad \text{Equation 9}$$

The following Equation 10 may be acquired from Equations 7, 8 and 9.

$$e_{i+1} = e_i - \frac{1}{j}\left(\sum_{k=i}^{i-j+1} e_k + \sum_{k=i}^{i-j+1} n_k\right) \qquad \text{Equation 10}$$

The noise ni is always less than a predetermined value and satisfies the following Equation 11. The average value of the noise ni is zero.

$$\|n_i\| \le \epsilon \qquad \text{Equation 11}$$

By Equation 11, Z-transform of Equation 10 may be represented by the following Equation 12.

$$\frac{E(z)}{N(z)} = \frac{c^{**}z}{z^j + \left(\frac{1}{j} - 1\right)z^{j-1} + \frac{1}{j}z^{j-2} \ldots + \frac{1}{j}} \qquad \text{Equation 12}$$

Here, C** is a constant.

All poles of Equation 12 are equal to radices of the following Equation 13.

$$z^j + \left(\frac{1}{j} - 1\right)z^{j-1} + \frac{1}{j}z^{j-2} \ldots + \frac{1}{j} = 0 \quad \text{Equation 13}$$

It will be appreciated that assuming that j of Equation 13 is "5 or more", absolute values of all radices of Equation 13 are greater than 1 and undergo divergence. In an embodiment, the divergence refers to color registration error does not undergo convergence, and consequently calibration of color registration error is not accomplished. Accordingly, convergence and calibration of color registration error are possible when the value of j is 4 or less. The reason why the value of j is 4 or less is the same as why n is 4 or less as mentioned in the description of FIG. 15.

Figure 16:
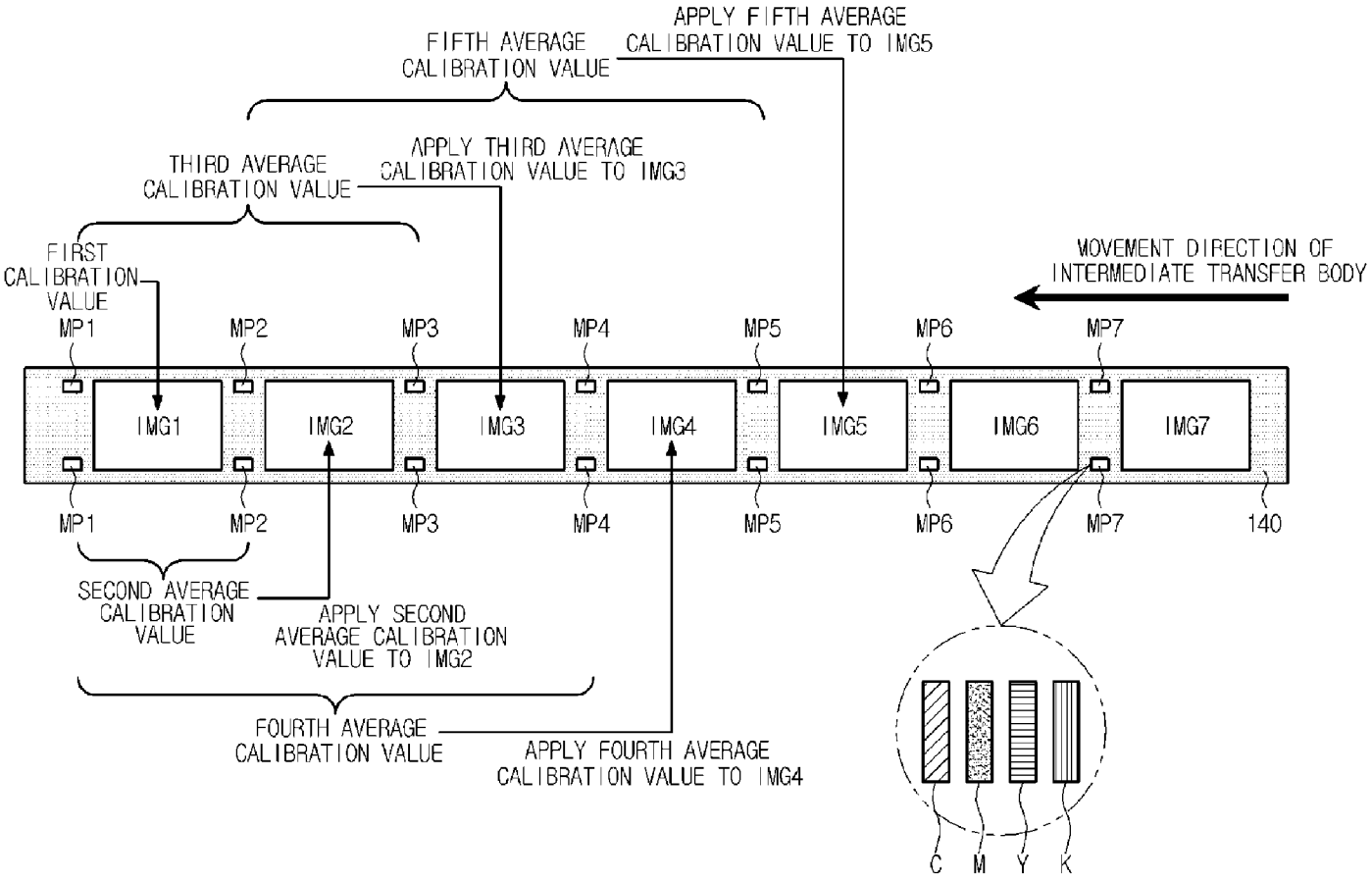
FIG. 16 is a view showing a real-time ACR procedure of the image forming apparatus according to an embodiment.

FIG. 16 is a view showing a real-time ACR procedure of an image forming apparatus according to an embodiment. As described above with reference to FIG. 15, main ACR is implemented on the image of the $i+n-1^{st}$ image forming section and the $i+n^{th}$ main-test pattern set using an average value of exposure time calibration values acquired from the $i^{th}$ main-test pattern set to the $i+n-1^{st}$ main-test pattern set, and n is a natural number of 4 or less. Assuming n=4, exposure time calibration is not implemented on images of first to third pages at the initial stage of printing for output of a plurality of pages. Therefore, via application of the method of FIG. 15, there is provided a method of calibrating exposure times with regard to images of first to third pages at the initial stage of printing for output of a plurality of pages. For example, images are formed in the plurality of image forming sections IMG1 to IMG7 of the intermediate transfer body 140 and the test-pattern sets MP1 to MP7 for color registration are formed in the respective blanks between the neighboring image forming sections IMG1 to IMG7, and color registration calibration is implemented using an average value of color registration calibration values acquired from four or less test pattern sets among the test pattern sets MP1 to MP7. Assuming that $\alpha$ is an integer of 1 or more, a color registration calibration value is acquired from an $m^{th}$ test pattern set to implement color registration calibration on an image of an $m^{th}$ image forming section and an $m+1^{st}$ test pattern set, a first average calibration value is acquired from the $m^{th}$ test pattern set to the $m+1^{st}$ test pattern set to implement color registration calibration on an image of an $m+1^{st}$ image forming section and an $m+2^{nd}$ test pattern set, a second calibration value is acquired from the $m^{th}$ test pattern set to an $m+2^{nd}$ test pattern set to implement color registration calibration on an image of an $m+2^{nd}$ image forming section and an $m+3^{rd}$ test pattern set, a third color registration calibration value is acquired from the $m^{th}$ test pattern set to the $m+3^{rd}$ test pattern set to implement color registration calibration on an image of an $m+3^{rd}$ image forming section and an $m+4^{th}$ test pattern set, and a fourth calibration value is acquired from the $m+1^{st}$ test pattern set to the $m+4^{th}$ test pattern set to implement color registration calibration on an image of an $m+4^{th}$ image forming section and an $m+5^{th}$ test pattern set.

FIG. 16 shows the intermediate transfer body 140 when viewed in a direction perpendicular to the surface of the intermediate transfer body 140. As exemplarily shown in FIG. 16, if a printing instruction is input, the image forming controller 161 controls transfer of the main-test pattern sets MP1 to MP7 to the non-image section of the intermediate transfer body 140 while controlling printing. The non-image section may be a section where an image is not formed (transferred). The non-image section may be a blank between the neighboring image forming sections IMG1 to IMG7, or may be a region around each of the image forming sections IMG1 to IMG7 having a predetermined width. That is, in one embodiment of the present invention, the entire region of the surface of the intermediate transfer body 140 except for the image forming sections IMG1 to IMG7 may be the non-image section.

In FIG. 16, the sequence of forming the main-test pattern sets MP1 to MP7 and images on the surface of the intermediate transfer body 140 is MP1-IMG1-MP2-IMG2-MP3-IMG3-MP4-IMG4-MP5-IMG5-MP6-IMG6-MP7-IMG7. That is, one main-test pattern set MP1 is formed, and then an image is formed in one image forming section IMG1. Subsequently, another main-test pattern set MP2 is formed, and then an image is formed in another image forming section IMG2. In this case, the number of the main-test pattern sets MP1 to MP7 and the number of images may be greater or less than that shown in FIG. 16 according to the number of pages to be output.

An exposure time calibration value with regard to each of the main-test pattern sets MP1 to MP7 exemplarily shown in FIG. 16 is basically acquired as described above with reference to FIGS. 1 to 14. Note that an average value of exposure time calibration values acquired from some of the plurality of main-test pattern sets MP1 to MP7 may be used when implementing main ACR of an image that will be formed next, and exposure time calibration values are acquired only from the previously formed (transferred) main-test patterns with regard to images of first to third pages at the initial stage of printing for output of a plurality of pages to implement main ACR (exposure time calibration) on an image of a next page. For example, as exemplarily shown in FIG. 16, the first main-test pattern set MP1 may be formed (transferred) before formation of the image forming section IMG1 of a first page, and main ACR on an image of the first page as well as an image of the second main-test pattern set MP2 may be implemented using a first exposure time calibration value acquired from the first main-test pattern set MP1. Thereafter, a second average calibration value of exposure time calibration values acquired respectively from the first main-test pattern set MP1 and the second main-test pattern set MP2 is calculated, and when forming images in the image forming section IMG2 of a next page and the third main-test pattern set MP3, main ACR may be implemented on the image of the image forming section IMG2 and the main-test pattern set MP3 using the second average calibration value. Subsequently, a third average calibration value acquired respectively from the first main-test pattern set MP1, the second main-test pattern set MP2 and the third main-test pattern set Mp3 is acquired, and when forming images in the image forming section IMG3 of a next page and in the fourth main-test pattern set MP4, main ACR may be implemented on the image of the image forming section IMG3 and the main-test pattern set MP4 using the third average calibration value. In this way, even before an average value of exposure time calibration values acquired respectively from the four main-test pattern sets MP1 to MP4 is calculated, main ACR may be implemented even on images of first to third pages at the initial stage of printing for output of a plurality of pages using the exposure time calibration values acquired from the previously formed main test pattern sets MP1 to MP3.

At this time, since the four main-test pattern sets MP1 to MP4 have been formed, via the above-described method of FIG. 15, a fourth average calibration value of exposure time calibration values acquired from each of the four main-test pattern sets MP1 to MP4 is calculated, and when forming images in the image forming section IMG4 next to the main-test pattern set MP4 and the main-test pattern set MP5, main ACR may be implemented on the image of the image forming section IMG4 and the main-test pattern set MP5 using the fourth average value. Subsequently, a fifth average calibration value of exposure time calibration values acquired from each of other four main-test pattern sets MP2 to MP5 is calculated, and when forming images in the image forming section IMG5 next to the main-test pattern set MP5 and the main-test pattern set MP6, exposure time for the image of the image forming section IMG5 and the test pattern set MP6 may be calibrated using the fifth average calibration value. Although FIG. 16 shows only the case in which the fourth average calibration value and the fifth average calibration value are acquired from four main-test pattern sets, it will be appreciated that a sixth average calibration value acquired from the following four main-test pattern sets MP3 to MP6 may be used when forming images in the next image forming section IMG6 and in the main-test pattern set MP7 to implement main ACR on the image of the image forming section IMG6 and the main-test pattern set MP7, and a seventh average calibration value acquired from the following four main-test pattern sets MP4 to MP7 may be used when forming images in the next image forming section IMG7 and in a main-test pattern set MP8 (not shown) to implement main ACR on the image of the image forming section IMG7 and the main-test pattern set MP8 (not shown). To summarize main ACR shown in FIG. 16, main ACR is implemented on an image of an $i+n-1^{st}$ image forming section and an $i+n^{th}$ main-test pattern set using an average value of exposure time calibration values acquired from an $i^{th}$ main-test pattern set to an $i+n-1^{st}$ main-test pattern set. Here, n is a natural number of 4 or less.

Figure 17:
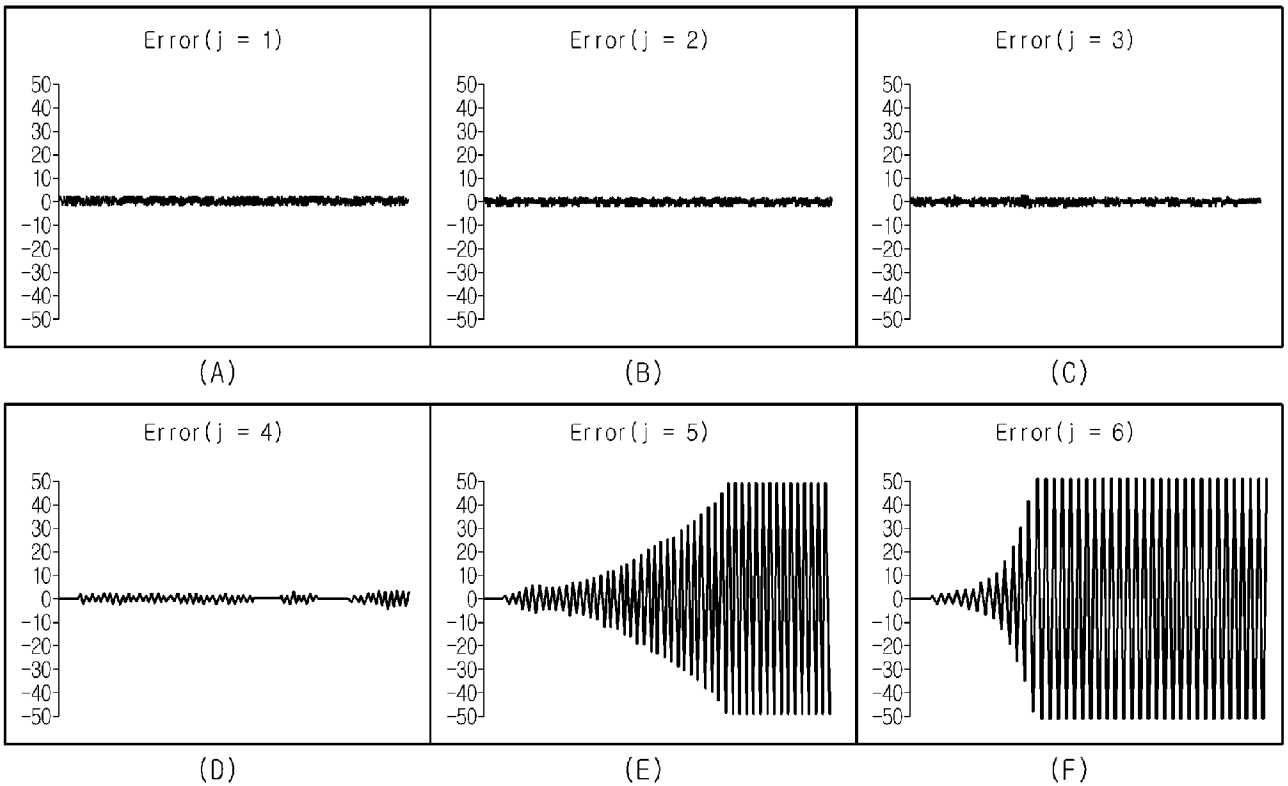
FIG. 17 is a view showing errors based on a real-time ACR test of the image forming apparatus according to an embodiment.

FIG. 17 is a view showing errors based on a real-time ACR test of the image forming apparatus according to an embodiment. In FIG. 17, (A) to (D) show errors when j of Equation 10 is 4 or less (i.e. n is a natural number of 4 or less), and (E) to (F) show errors when j is 5 or more. As described above with reference to FIG. 15, in the image forming apparatus according to the embodiment of the present invention, main ACR is implemented on an image of the $i+n-1^{st}$ image forming apparatus and an $i+n^{th}$ main-test pattern set using an average value of exposure time calibration values acquired from the $i^{th}$ main-test pattern set to the $i+n-1^{st}$ main-test pattern set, and n is a natural number of 4 or less. Error values undergo convergence when j of Equation 10 is 4 or less (i.e. n is a natural number of 4 or less) as will be appreciated from (A) to (D) of FIG. 17, whereas error values undergo divergence and are unstable when j is 5 or more (i.e. n is a natural number of 5 or more) as will be appreciated from (E) and (F) of FIG. 17.

Figure 18:
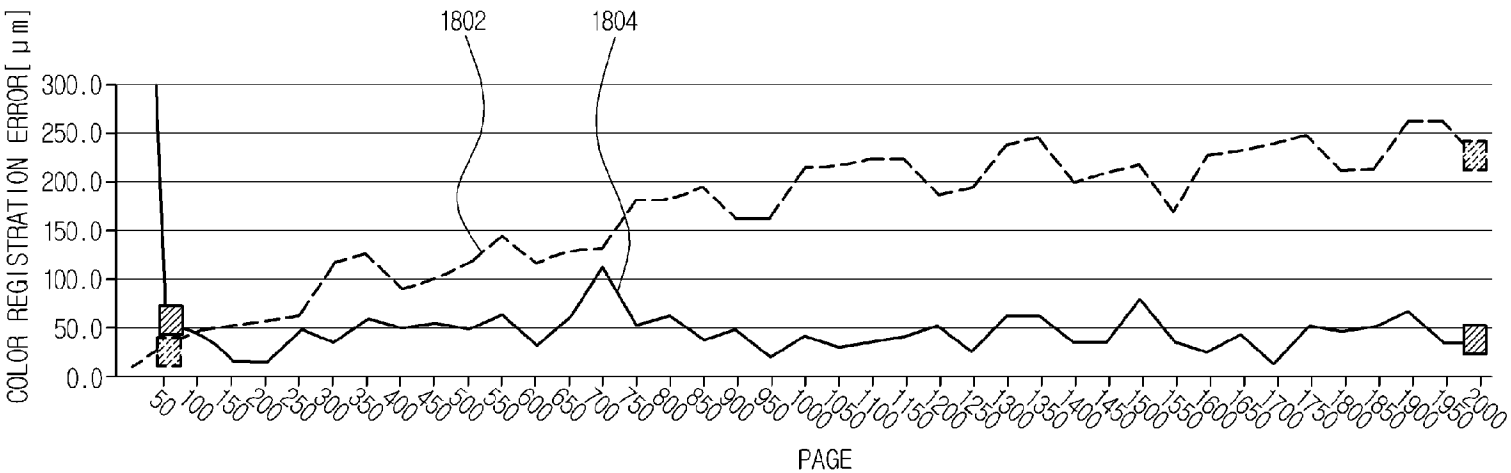
FIG. 18 is a view showing color registration results based on real-time ACR when the image forming apparatus outputs a plurality of pages according to an embodiment.

FIG. 18 is a view showing color registration results based on real-time ACR when a plurality of pages is output from the image forming apparatus according to an embodiment. In the graph of FIG. 18, the vertical axis denotes registration error (μm) and the horizontal axis denotes the number of output pages. It will be appreciated that a total of 2000 pages has been output. In addition, in the graph of FIG. 18, curve 1802 denotes general color registration error under non-application of real-time ACR, and curve 1804 denotes color registration error under application of real-time ACR. As will be appreciated from the curve 1802 of FIG. 18, error increases as the number of output pages increases under non-application of real-time ACR as shown by curve 1802, whereas color registration error is kept very low value during output of 2000 sheets under application of real-time ACR.

As is apparent from the above description, an image forming apparatus and a control method for the same according to an aspect of the present invention may reduce time required for color registration and calibrate color position shift of all printed matters.

Although embodiments of the disclosure have been shown and described, it would be appreciated by those skilled in the art that changes may be made in the embodiment without departing from the principles and spirit of the disclosure, the scope of which is defined in the claims and their equivalents.

What is claimed is:

1. An image forming apparatus comprising:

a plurality of photoconductors corresponding to a plurality of colors;

an exposure unit configured to form an electrostatic latent image by emitting light to the plurality of photoconductors;

a developing unit configured to form a toner image by feeding toner to the plurality of photoconductors;

an intermediate transfer body to which the toner image, formed on each of the plurality of photoconductors, is transferred;

a sensing unit configured to sense the toner image formed on the intermediate transfer body; and a controller which forms images in a plurality of image forming sections of the intermediate transfer body and forms test-pattern sets for color registration in respective blanks between the neighboring image forming sections, and which implements color registration calibration using color registration calibration values acquired from four or less test pattern sets among the formed test pattern sets, wherein the controller implements color registration calibration using an average calibration value of the color registration calibration values acquired from the four test pattern sets, and wherein the controller acquires an average calibration value from an $m^{th}$ test pattern set to an $m+3^{rd}$ test pattern set when m is an integer of 1 or more, and implements the color registration calibration on an image of an $m+3^{rd}$ image forming section and an $m+4^{th}$ test pattern set.

2. The apparatus according to claim 1, wherein the controller forms the test pattern sets for color registration in the blanks between the respective neighboring image forming sections in a one to one ratio.

3. The apparatus according to claim 1, wherein the single test pattern set includes at least one reference color pattern and at least one comparative color pattern.

4. The apparatus according to claim 1, wherein the single test pattern set includes a plurality of reference color patterns and a plurality of comparative color patterns.

5. The apparatus according to claim 1, wherein the plurality of photoconductors is arranged side by side in tandem in a movement direction of the intermediate transfer body.

6. An image forming apparatus comprising:

a plurality of photoconductors corresponding to a plurality of colors;

an exposure unit configured to form an electrostatic latent image by emitting light to the plurality of photoconductors;

a developing unit configured to form a toner image by feeding toner to the plurality of photoconductors;

an intermediate transfer body to which the toner image, formed on each of the plurality of photoconductors, is transferred;

a sensing unit configured to sense the toner image formed on the intermediate transfer body; and a controller which forms images in a plurality of image forming sections of the intermediate transfer body and forms test-pattern sets for color registration in respective blanks between the neighboring image forming sections and which implements color registration calibration using color registration calibration values acquired from four or less test pattern sets among the formed test pattern sets, wherein the color registration calibration value acquired from the first test pattern set is used to implement the color registration calibration on the image of the first image forming section and the second test pattern set;

wherein the color registration calibration values acquired from the first test pattern set and the second test pattern set are used to implement the color registration calibration on the image of the second image forming section and the third test pattern set;

wherein the color registration calibration values acquired from the first test pattern set to the third test pattern set are used to implement the color registration calibration on the image of the third image forming section and the third test pattern set; and wherein, assuming that m is an integer of 1 or more, calibration values are acquired from an $m^{th}$ test pattern set to an $m+3^{rd}$ test pattern set and used to implement the color registration calibration on an image of an $m+3^{rd}$ image forming section and an $m+4^{th}$ test pattern set.

7. The apparatus according to claim 6, wherein the controller implements color registration calibration using an average calibration value of the color registration calibration values acquired from the four test pattern sets.

8. The apparatus according to claim 6, wherein the single test pattern set includes at least one reference color pattern and at least one comparative color pattern.

9. The apparatus according to claim 6, wherein the single test pattern set includes a plurality of reference color patterns and a plurality of comparative color patterns.

10. The apparatus according to claim 6, wherein the plurality of photoconductors is arranged side by side in tandem in a movement direction of the intermediate transfer body.

11. A control method for an image forming apparatus, the apparatus comprising a plurality of photoconductors corresponding to a plurality of colors, an exposure unit configured to form an electrostatic latent image by emitting light to the plurality of photoconductors, a developing unit configured to form a toner image by feeding toner to the plurality of photoconductors, an intermediate transfer body to which the toner image, formed on each of the plurality of photoconductors, is transferred, and a sensing unit configured to sense the toner image formed on the intermediate transfer body, the method comprising:

forming images in a plurality of image forming sections of the intermediate transfer body and test-pattern sets for color registration in respective blanks between the neighboring image forming sections; and implementing color registration calibration using color registration calibration values acquired from four or less test pattern sets among the formed test pattern sets, wherein the color registration calibration is implemented using an average calibration value of the color registration calibration values acquired from the four test pattern sets, and wherein, assuming that m is an integer of 1 or more, a first average calibration value is acquired from an $m^{th}$ test pattern set to an $m+3^{rd}$ test pattern set and used to implement the color registration calibration on an image of an $m+3^{rd}$ image forming section and an $m+4^{th}$ test pattern set.

12. The method according to claim 11, wherein the color registration calibration value acquired from the first test pattern set is used to implement the color registration calibration on the image of the first image forming section and the second test pattern set;

wherein the color registration calibration values acquired from the first test pattern set and the second test pattern set are used to implement the color registration calibration on the image of the second image forming section and the third test pattern set; and wherein the color registration calibration values acquired from the first test pattern set to the third test pattern set are used to implement the color registration calibration on the image of the third image forming section and the third test pattern set.

13. The method according to claim 11, wherein the single test pattern set includes at least one reference color pattern and at least one comparative color pattern.

14. The method according to claim 11, wherein the single test pattern set includes a plurality of reference color patterns and a plurality of comparative color patterns.

15. The method according to claim 11, wherein the plurality of photoconductors is arranged side by side in tandem in a movement direction of the intermediate transfer body.

* * * * *